US009989251B2

(12) United States Patent
Tummillo et al.

(10) Patent No.: US 9,989,251 B2
(45) Date of Patent: Jun. 5, 2018

(54) SYSTEM FOR GASIFYING WASTE, METHOD FOR GASIFYING WASTE

(71) Applicant: CONVERSION ENERGY SYSTEMS, INC., Burr Ridge, IL (US)

(72) Inventors: Matthew J Tummillo, St. Charles, IL (US); Peter J Schubert, Indianapolis, IN (US); Johnny R Chapman, Lemont, IL (US); Peter T Caine, Watertown, WI (US); Harley S Melbye, Jr., Oconomowoc, WI (US); Richard L Natwora, Jr., Wauwatosa, WI (US)

( * ) Notice: Subject to any disclaimer, the term of this patent is extended or adjusted under 35 U.S.C. 154(b) by 180 days.

(21) Appl. No.: 14/159,740

(22) Filed: Jan. 21, 2014

(65) Prior Publication Data

US 2014/0305926 A1 Oct. 16, 2014

Related U.S. Application Data

(60) Provisional application No. 61/754,895, filed on Jan. 21, 2013.

(51) Int. Cl.
*F27D 11/00* (2006.01)
*F23G 5/50* (2006.01)
(Continued)

(52) U.S. Cl.
CPC ..... *F23G 5/50* (2013.01); *F23G 5/0276* (2013.01); *F23G 5/448* (2013.01); *F23G 5/46* (2013.01);
(Continued)

(58) Field of Classification Search
CPC . H05B 3/06; F23G 5/46; F23G 5/0276; F23G 5/50; F23G 5/80; F23G 5/448; F23G 2900/00001; F23G 2203/10; F23G 2203/80; F23G 2204/20; F23G 2201/40; F23G 2206/10; F23J 1/00; F23J 1/02
See application file for complete search history.

(56) References Cited

U.S. PATENT DOCUMENTS 4,309,195 A 1/1982 Rotter
4,469,488 A 9/1984 Calderon
(Continued)

*Primary Examiner* — Shawntina Fuqua
(74) *Attorney, Agent, or Firm* — Cherskov Flaynik & Gurda, LLC

(57) ABSTRACT

The invention provides a system for reducing the volume of bulk material, comprising a transportable container; a single chamber adapted to receive said transportable container; a means for establishing a plurality of controlled atmospheres within said chamber; a plurality of electrically-charged heating elements capable of heating said chamber to at least 1200 F; and an waste heat generator in fluid communication with the chamber. A method for simultaneously thermally degrading different waste differently in a single chamber, comprising filling each container within a plurality of containers with preselected waste and placing each container within the chamber at preselected positions; establishing a controlled atmosphere within the chamber and applying heat to the waste for a time and at a temperature sufficient to gasify the waste; collecting thermal degradation data during gasification; and applying the collected data to an algorithm to adjust the temperature and oxygen concentrations for each preselected position.

12 Claims, 47 Drawing Sheets

(51) Int. Cl.
*F23G 5/027* (2006.01)
*F23G 5/44* (2006.01)
*F23G 5/46* (2006.01)

(52) U.S. Cl.
CPC ..... *F23G 2201/40* (2013.01); *F23G 2203/80* (2013.01); *F23G 2204/20* (2013.01); *F23G 2206/10* (2013.01); *F23G 2900/00001* (2013.01)

(56) References Cited

U.S. PATENT DOCUMENTS 4,472,245 A 9/1984 Halm
4,673,413 A 6/1987 Strong
4,854,944 A 8/1989 Strong
5,054,405 A 10/1991 Walker
5,069,765 A 12/1991 Lewis
5,269,472 A * 12/1993 Koenig ..... B09B 3/00 110/232
5,280,757 A 1/1994 Carter et al.
5,387,321 A 2/1995 Holland
5,423,891 A 6/1995 Taylor
5,487,873 A 1/1996 Bridges et al.
5,788,723 A 8/1998 Kiss
5,803,936 A 9/1998 Huber
5,960,722 A 10/1999 Kiss
6,018,471 A 1/2000 Titus
6,155,182 A 12/2000 Tsangaris et al.
6,196,144 B1 3/2001 Kiss
6,439,135 B1 8/2002 Pope
6,747,067 B2 6/2004 Melnichuk et al.
6,786,943 B1 9/2004 Jaccard et al.
6,843,814 B1 1/2005 Schingnitz et al.
6,972,114 B2 12/2005 Pope et al.
7,037,473 B1 5/2006 Donner et al.
7,302,897 B2 12/2007 Pallett et al.
2004/0237861 A1 12/2004 Azuma et al.
2006/0075945 A1 4/2006 Batdorf
2006/0219139 A1 * 10/2006 Pope ..... F23G 5/002 110/229
2007/0220810 A1 9/2007 Levenson
2007/0272131 A1 11/2007 Carabin et al.
2007/0289509 A1 12/2007 Vera

* cited by examiner

| | |
|---|---|
| *Fig. 10a* | *Fig. 10b* |
| *Fig. 10c* | *Fig. 10d* |

124
1
CB327
327
(5A)
324
N1
L
G
N
PS1
SOLA POWER SUPPLY
SDN10-24-100P
24VDC
+V
COM
1
401
425
N1
401
425
+24VDC
DC CON
E-STOP
IPP1
331
331A
331B
ESR
(JUMPER)
(JUMPER)
332, 334,403,
427, 1112
ESR
332
IPP1
R
C8333
(0.5A)
333
425
1101
DC COM
DC INPUT
CARD
ESR
334
C8336
(2A)
336
1125
1123
DC COM
DC OUTPUT
CARD
C8337
(2A)
337
1201
1201
DC COM
DC OUTPUT
CARD
C8338
(0.5A)
338
919
920
DC COM
ANALOG
OUTPUT CARD
C8339
(0.5A)
339
943
944
DC COM
ANALOG
OUTPUT CARD
CB340
(0.5A)
340
503
503
DC COM
COMBUSTION
AIR DAMPER #1

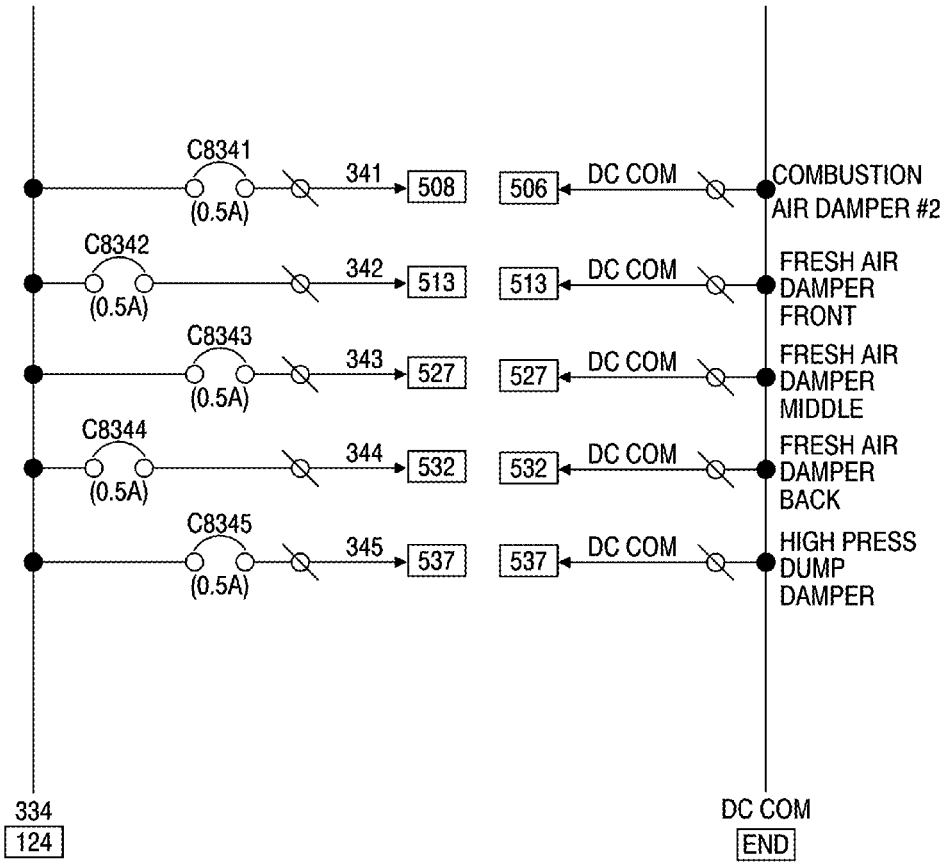
*Fig. 12b*
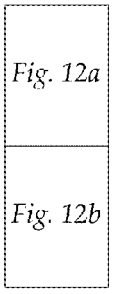

329
1
ESR
426
PEAKTRONICS
LRC-100
J2
J1
C8428
(5A)
428
905
906
SHLD
OLC-433
WATLOW
LVC6-KW00002500A
C8433
(0.5A)
433
TE-005
10 L1
L2 9
4 TC+
3 TC-
7 COM
OLC-439
WATLOW
LVC6-KW00002500A
C8439
(0.5A)
439
TE-006
426
END

329
N1
OPEN OUTPUT
MOTOR NEUTRAL
THERMAL SWITCH
CLOSE OUTPUT
GND
WIPER
+10V
FEEDBACK POT
OXIDIZER INLET
VALVE CONTROLLER
HGV-001
OXIDIZER HIGH
LIMIT CONTROLLER
MC435
436
C
135,137,139,1105
GASIFIER HIGH
LIMIT CONTROLLER
MC441
442
C
141,143,145,1106
N1
END

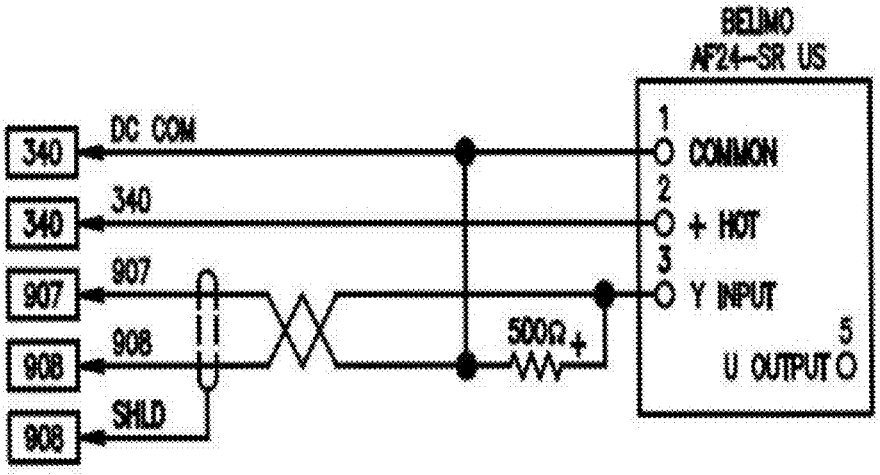
FIG. 15A
FIG. 15B
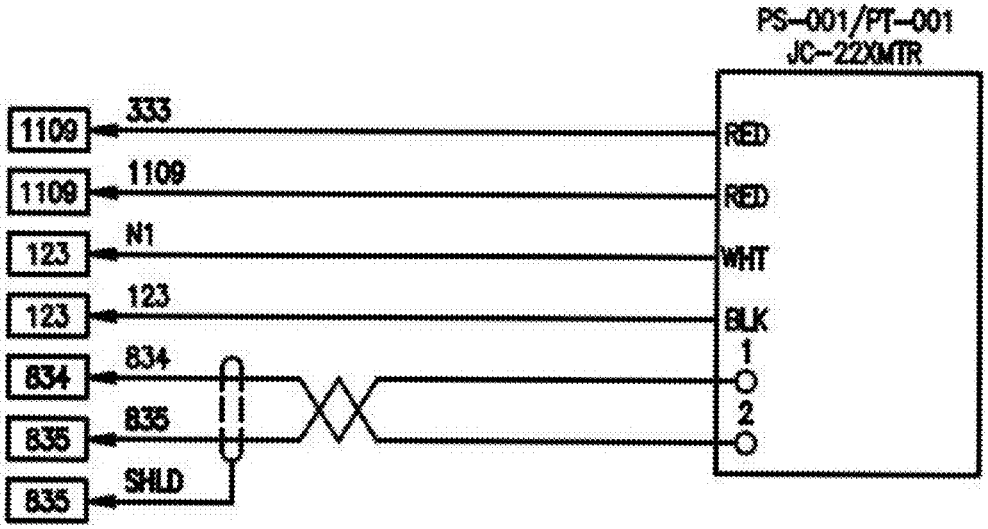

SW2: V IN 0-10V/0-20MA SELECTIVE
SW3: S6 0-10V/0-20MA SELECTIVE
I POSITION :0-20MA SIGNAL
:0-10MA SIGNAL
SW1: NPN/PNP SELECTIVE 333
333
VFD1425
R1C
R1B
VFD1425
R2B
R2A
MC435
(NOTE)1
MC441
(NOTE)1
CS-001
CS-002
542
542
CS-003
ESR
START
IPB2
STOP
PB3
PB4
LOADING AND
MAINTANCE
PB5
PB6
333
333

| | |
|---|---|
| *Fig. 24a* | *Fig. 24b* |

337
337
RACK 1 SLOT 11
1746-OW16
VAC/VDC
OUT0
(0:11/0)
OUT1
(0:11/1)
OUT2
(0:11/2)
OUT3
(0:11/3)
OUT4
(0:11/4)
OUT5
(0:11/5)
OUT6
(0:11/6)
OUT7
(0:11/7)
1204
1205
1206
1207
1208
1209
1210
1211
IPB2
PL7
G
6W
337
DC COM
CYCLE RUNNING
CYCLE RUNNING
SPARE
SPARE
SPARE
SPARE
SPARE
SPARE
SPARE
121
121
121
VAC/VDC
OUT0
(0:11/8)
OUT1
(0:11/9)
OUT2
(0:11/10)
OUT3
(0:11/11)
OUT4
(0:11/12)
OUT5
(0:11/13)
OUT6
(0:11/14)
OUT7
(0:11/15)
1213
1214
1215
1216
1217
1218
1219
1220
SOL1213
SOL1214
SOL1215
121
N1
CFM PURGE VALVE
CO, 02, AND H2
PURGE VALVE
HC PURGE VALVE
SPARE
SPARE
SPARE
SPARE
SPARE

Fig. 27Aa
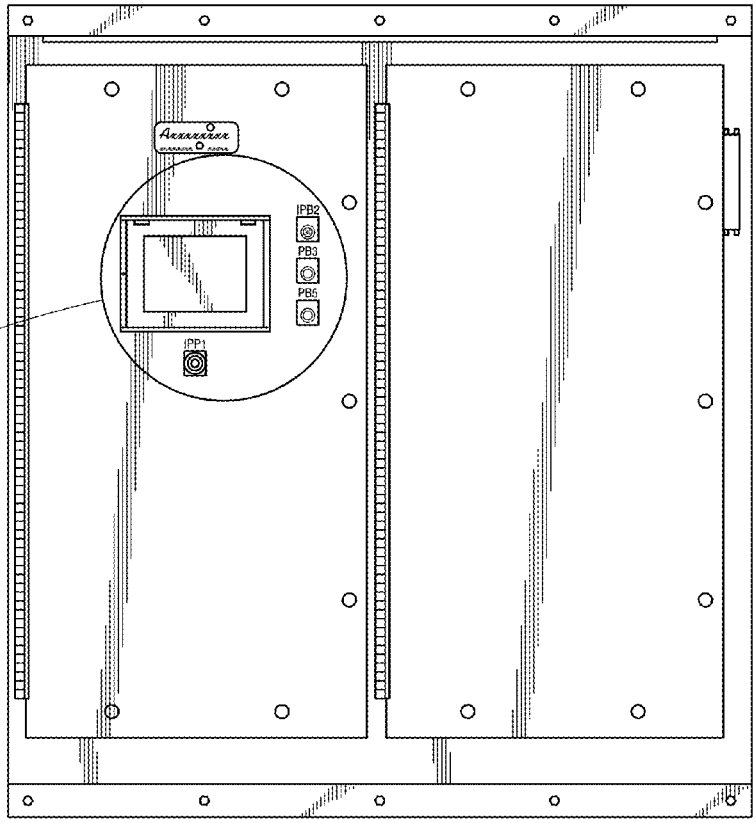
Fig. 27Ab
Fig. 27Ab
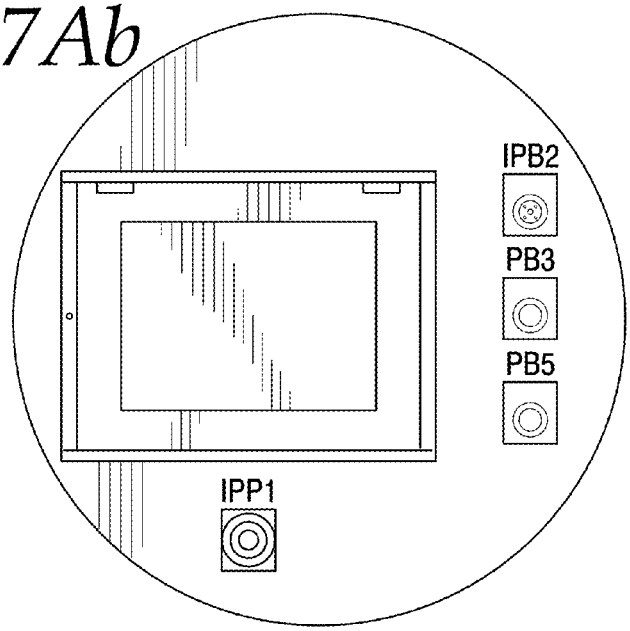

| | | |
|---|---|---|
| | *Fig. 29b* | *Fig. 29d* |
| *Fig. 29a* | *Fig. 29c* | *Fig. 29e* |

SYSTEM FOR GASIFYING WASTE, METHOD FOR GASIFYING WASTE

REFERENCE TO RELATED APPLICATIONS

The present invention claims priority to U.S. Provisional Patent Application No. 61/754,895, filed on Jan. 21, 2013.

BACKGROUND OF THE INVENTION

1. Field of the Invention

The present invention relates to a method and system for reducing the volume of bulk material, and specifically, the present invention relates to a method and system for gasifying waste to produce energy.

2. Background of the Invention

Municipal landfills are filling up. While recycling efforts are ongoing to reduce the volume being landfilled, the bulk of municipal solid waste is buried.

Efforts are ongoing to reduce waste volumes via thermal degradation. U.S. Pat. No. 5,387,321 (to Holland) uses microwave electromagnetic radiation (EMR) heating, adding scrap tires and the like as absorbers for microwave energy.

U.S. Pat. No. 5,487,873 (to Bridges, et al.) uses radio frequency EMR to accomplish pyrolysis in an oxygen free atmosphere.

U.S. Pat. No. 5,069,765 (to Lewis) and U.S. Pat. No. 4,472,245 (to Halm) describe electric arc methodologies to also pyrolyze organic materials.

U.S. Pat. No. 6,155,182 (to Tsangaris et al.), U.S. Pat. No. 6,018,471 (to Titus et al.) and U.S. Pat. No. 5,280,757 (to Carter et al.) disclose methods of using plasma arc technology for driving the pyrolysis of organic feed material.

Recently, plasma technology has been considered in the thermal degradation of garbage. Users of the energy provided by plasma systems pay approximately $58 to $60 per MW-hour, compared to $62 per MWh for power provided by typical biomass-fueled facilities. However, plasma systems are typically stationary. And the capital outlays for such systems are enormous, at well over $150 million per plant. Also, the initial energy inputs are high.

All of the aforementioned technologies, using EMR, plasma generation or electric arc methods, are limited in through-put capacity to just a few tons per day, and have been used economically only for destroying trash with high disposal costs, such as medical, industrial hazardous waste, and nuclear waste.

A need exists in the art for a system and method for reducing the volume of municipal solid waste prior to disposal. The system and method should be economical such that energy created as part of the volume reducing effort can be utilized to provide energy to downstream processes, such as drying operations, boilers or steam turbines. The system and method should be transportable. Also the system and method should be brought up to operational status within 60 minutes after being charged with material to be reduced.

SUMMARY OF INVENTION

An object of the invention is to provide a system and method for reducing the volume of bulk materials that overcomes many of the disadvantages of the prior art.

Another object of the present invention is to provide a method and system for gasifying municipal waste. A feature of the invention is that the gasifier thermally degrades the waste without burning it. A feature of the invention is the production of secondary energy streams.

Yet another object of the present invention is to provide a method and system for enabling waste generators to reduce the bulk of the volume of their waste in situ. A feature of the invention is its transportability to various generation sites. An advantage of the invention is that secondary energy streams it generates can be utilized at those sites.

Still another object of the present invention is to provide batch or continuous processing of municipal waste. A feature of the invention is the ability to accept untreated waste, and to reduce by 95 percent, the volume of 100 tons of waste in a complete cycle time of between about 8 and 12 hours. An advantage of the invention is rapid on-site reduction of waste, at the rate of 200 tons per day (or multiples thereof) to minimize volumes for eventual land filling.

Yet another object of the present invention is to provide a method and system for batch and continuous feed volume reduction. A feature of the invention is that the system operates at between about 800 and 1400° F. without the need for fossil fuel combustion during the start up of thermal degradation process; rather, electrical energy is used to initiate the heats of reaction. An advantage of the invention is that it does not slag recyclables, thereby providing recovery rates of at least about 95 percent.

Briefly, the invention provides a transportable system for reducing the volume of bulk material, the system comprising a container (such as a dumpster, basket or other waste receptacle); a single chamber adapted to receive said container; a means for establishing a plurality of controlled atmospheres within said chamber; a plurality of electrically-charged heating elements capable of heating said chamber to up to about 2200° F.; and a waste heat generator in fluid communication with the chamber. The system is adapted to receive a plurality of containers.

Also provided is a method for simultaneously thermally degrading different waste differently in a single chamber, the method comprising filling a container or a plurality of containers with Municipal Solid Waste and placing each container within the chamber at preselected positions; establishing a controlled atmosphere within the chamber and applying heat to the waste for a time and at a temperature sufficient to gasify the waste; collecting data during gasification regarding the thermal degradation of the waste; and applying the collected data to an algorithm to adjust the temperature and oxygen concentrations for each preselected position.

BRIEF DESCRIPTION OF DRAWINGS

The invention together with the above and other objects and advantages will be best understood from the following detailed description of the preferred embodiment of the invention shown in the accompanying drawings, wherein:

FIGS. 12*a-b* provide a schematic representation of the D/C redundant power supply;

FIGS. 15A and 15B depict a representative damper actuator and pressure transmitter;

FIG. 27Aa is a depiction of a control panel and display;

FIG. 27Ab is a detail view of the display featured on the control panel of FIG. 27Aa;

DETAILED DESCRIPTION OF THE INVENTION

The invention provides a system and method for gasifying a variety of wastes. One result of utilizing the invention is a reduction of the volume of the waste to no more than five percent its original volume. Another result of utilizing the invention is the generation of producer gas for subsequent use, preferably on site. Producer gas includes hydrogen combined with carbon monoxide, carbon dioxide, and perhaps trace quantities of nitrogen and one- to three-carbon hydrocarbons. Producer gas may be burned directly in internal combustion engines, used to produce methanol and hydrogen, or converted via the Fischer-Tropsch process into synthetic fuel.

The invented system relies primarily on gasification, initiated by electrical energy, to achieve the aforementioned volume reductions. Gasification converts carbonaceous materials, such as plant waste, municipal waste, animal waste, medical waste, distiller's grain, or other biomass, by reacting the raw material at high temperatures (i.e., above 800° F.) with a controlled amount of oxygen.

Gasification can utilize materials that are not otherwise useful fuels, such as biomass or organic waste. Biomass gasification is carbon neutral.

The invention optimizes the recycling of glass, metals and other substrates which do not thermally decompose in the system's 800° F. to 1400° F. target range of operation. Recovery of glass and metal is greater than 95 percent. Other heretofore recalcitrant waste, such as plastics and like consumables, are degraded to low to medium carbon length structures, thereby contributing to the producer gas fraction mentioned supra, and adding to the secondary fuel stream.

The system and method requires no sorting, sizing, drying or segregating of waste prior to thermal treatment.

A prototype of the invented system nets from 3 million to 5.5 million BTUs per hour of heat energy from 3 to 5 tons of municipal solid waste treated. Less than 1 million BTUs are required to initiate the gasification process.

A single module of the system is capable of processing up to 100 cubic yards of waste in a single shift (6-8 hours of continuous operation). When modules operate in continuous batch mode, multiples of that tonnage are processed. The modularity of this system allows one or a plurality of modules to be transported to waste processing sites and/or to be remain on a vehicle for processing of waste at various sites.

Figure 1:
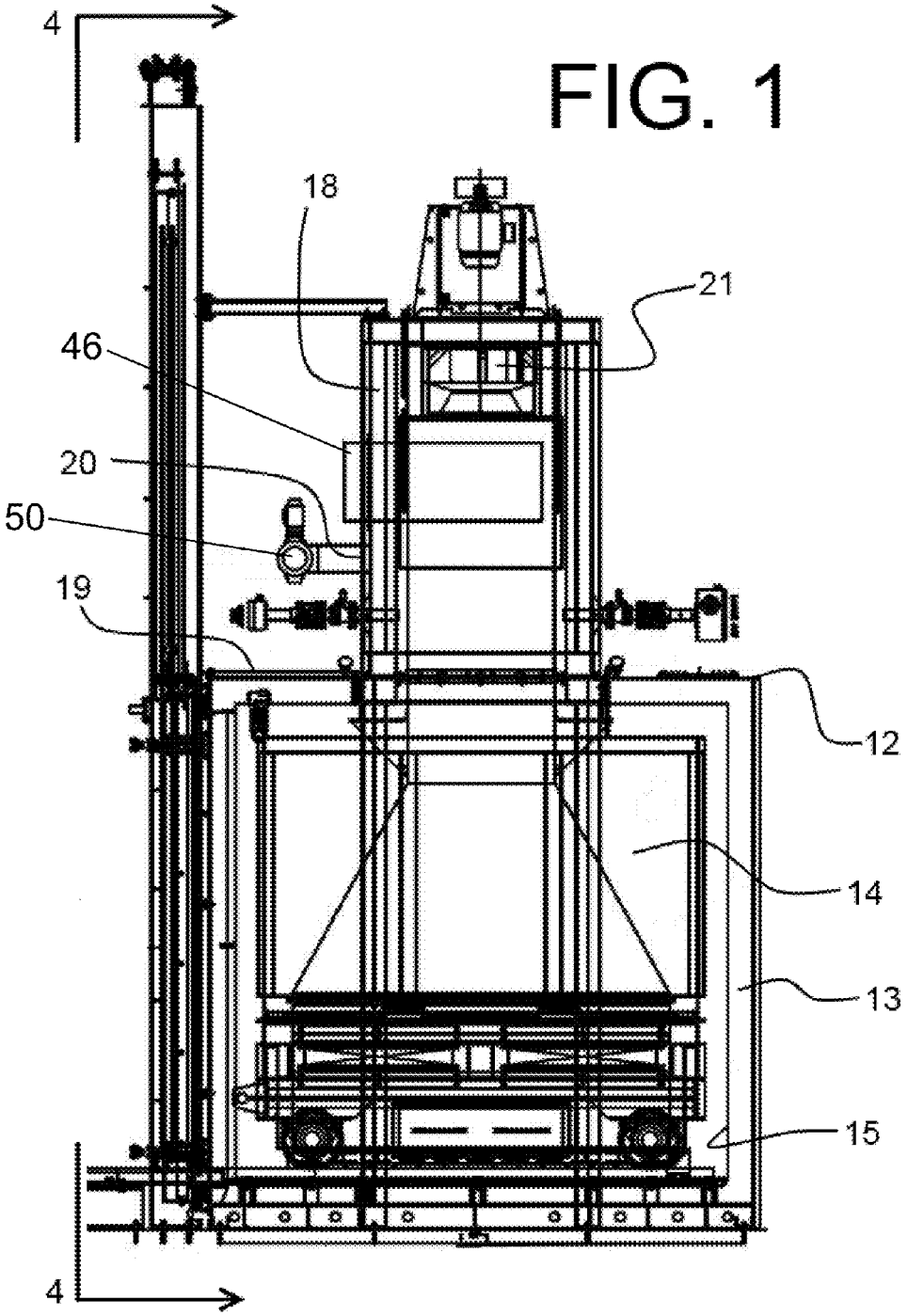
FIG. 1 is a diagram of a waste gasification system, in accordance with features of the present invention.
Figure 5:
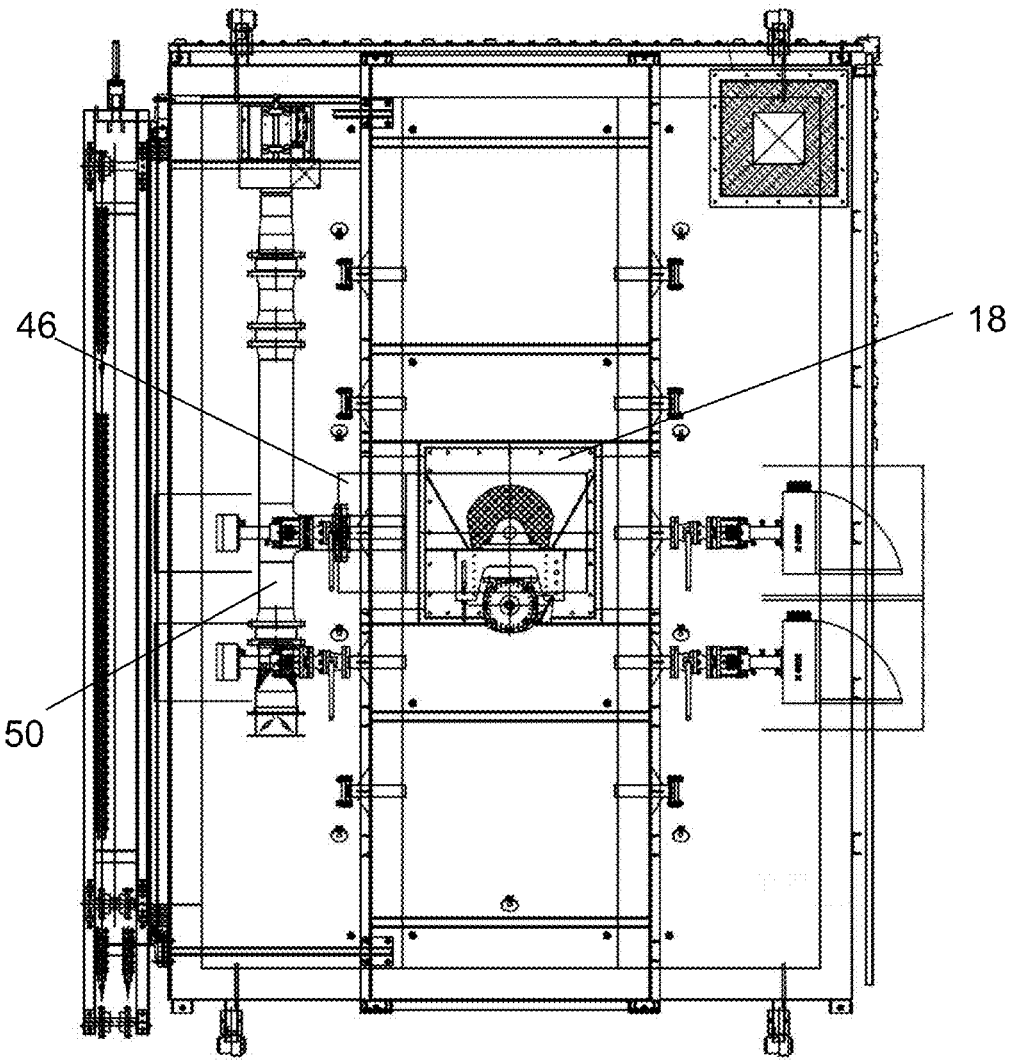
FIG. 5 is a plan view of the ceiling of a gasification chamber for use with the invented system, in accordance with features of the present invention.

FIG. 1 depicts an exemplary system, designated as element 10 embodying aspects of the invention. FIG. 5 provides a plan view of the same exemplary embodiment of the system. A gasification chamber 12 is provided to thermally treat the waste. One or a plurality of walls of the chamber 12 is/are adapted to removably receive a container 14 (designated in phantom) of waste. Details of the container are discussed infra and in FIGS. 2 and 3A-F. Further, schematic designs of the system are represented in FIGS. 9-26. A more general schematic of the airflow and operational controls is shown in FIGS. 29*a-e*.

A means of egress 20 of gases generated during the gasifying process is provided, the means in fluid communication with an interior of the chamber. In one embodiment of the system, the means of egress 20 is integrally molded with the chamber.

A salient feature of the device is a waste heat generator 18 positioned downstream (reaction-wise), and in fluid communication with the gasifying unit. The means of egress 20 of the gas is situated intermediate the waste heat generator and the gasifying chamber 12. A conduit 22 provides a means for directing fluid from the gasifying chamber 12 to the waste heat generator 18. The conduit is adapted to receive and direct fluid at ambient pressure, at negative pressures, or at positive pressures. In one embodiment of the system, typical fluid flows are at negative pressure, such that gasification fluid from the chamber 12 is drawn into the waste heat generator instead of expanding into the waste heat generator 18. A suitable negative pressure is 0.10" water.

The waste heat generator treats producer gas produced as a result of the invented gasification process, and converts constituents of the producer gas to their fully oxidized moieties, as depicted in Equation 1, infra. The presence of producer gas indicates that the reaction conditions inside the chamber are neither pyrolytic nor supportive of continuous combustion. Rather, oxygen levels within the chamber are kept between 4 percent and 12 percent, and preferably 7 percent.

Figure 6:
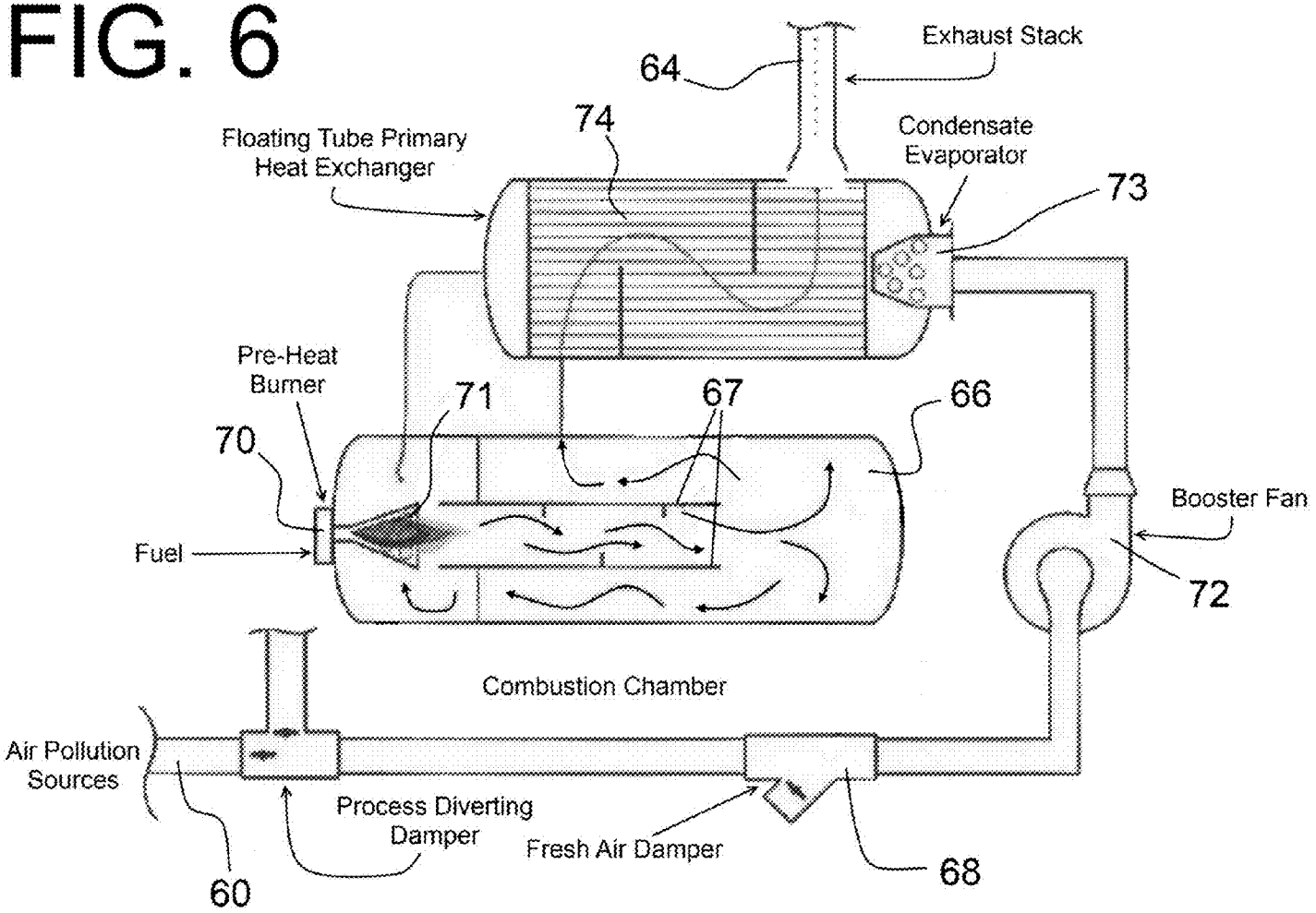
FIG. 6 is a schematic view of a waste heat generator for use with the invented system, in accordance with features of the present invention.

Details of the waste heat generator are found infra and in FIG. 6. Suitable thermal waste heat generators 18 are commercially available from a myriad of suppliers, including Catalytic Products, International, Lake Zurich, Ill.

Container

Detail

Figure 2:
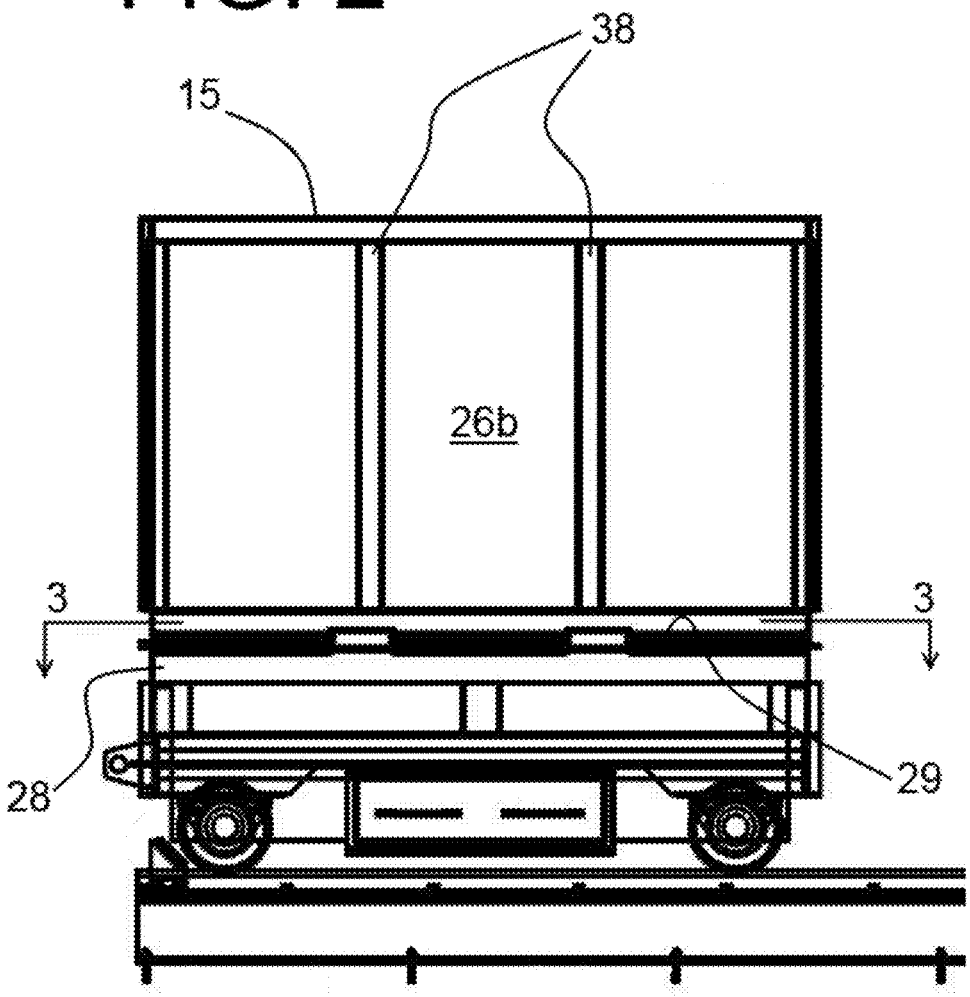
FIG. 2 is an elevation view of a transportable waste container for use with the invented system, in accordance with features of the present invention.

FIG. 2 depicts the container 14 as a virtually cuboid structure, but other geometric configurations are suitable. In one embodiment of the invention, the top 15 of the structure is open so as to facilitate solid and fluid exchange with the interior of the chamber 12. As depicted in FIG. 2, the open top 15 facilitates loading of the container 14 with solid waste for subsequent gasification. The open top also facilitates gaseous exchange between the interior of the container and areas above the container 14.

Figure 3A:
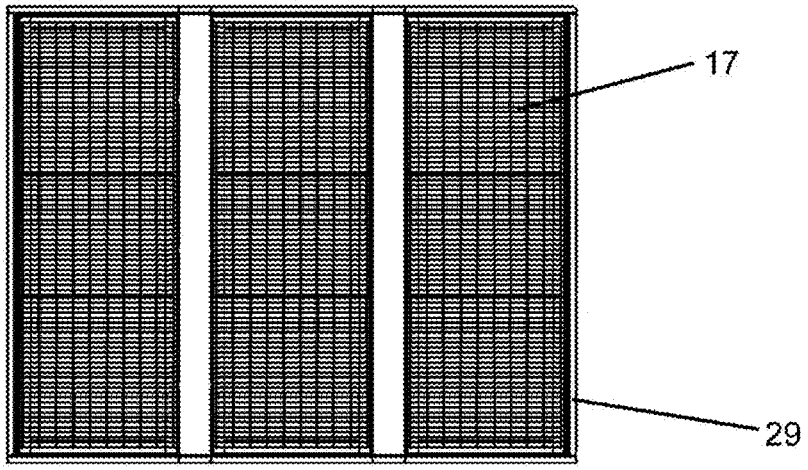
FIG. 3A is a view of FIG. 2, taken along lines 3-3.
Figure 3B:
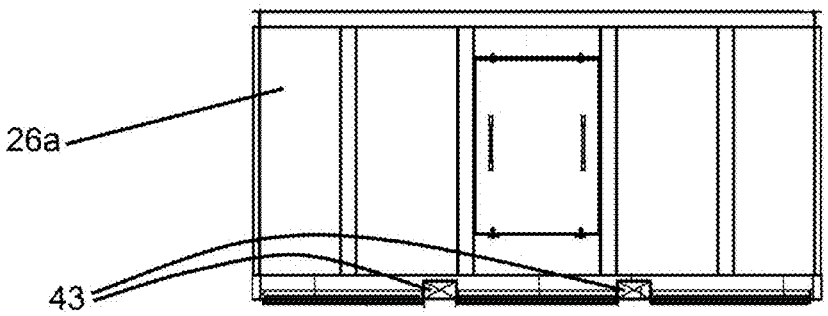
FIGS. 3B-3F are component views of the bin and cart components.
Figure 3C:
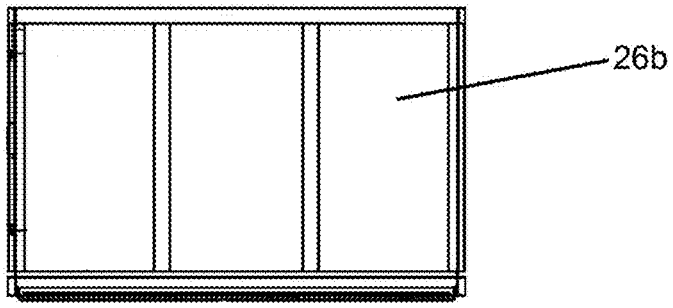
Figure 3D:
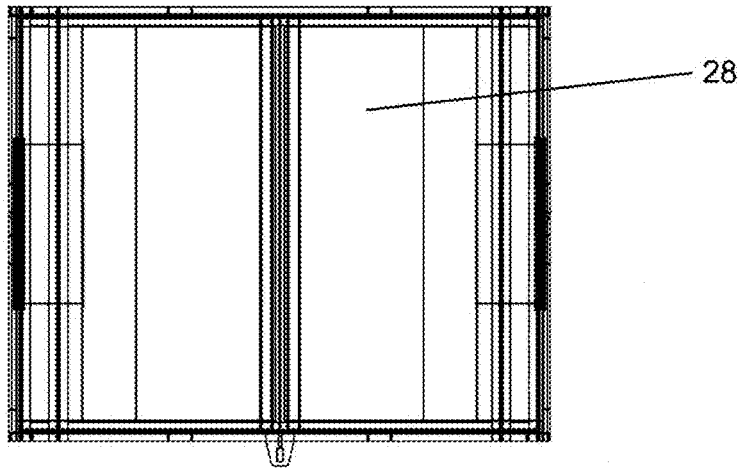
Figure 3E:
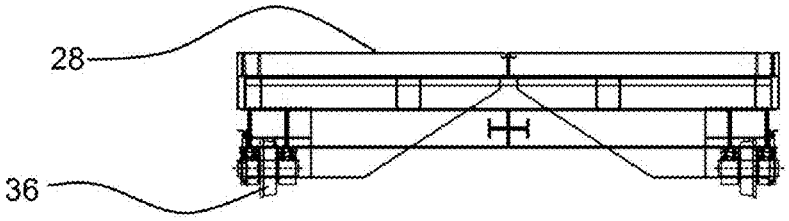
Figure 3F:
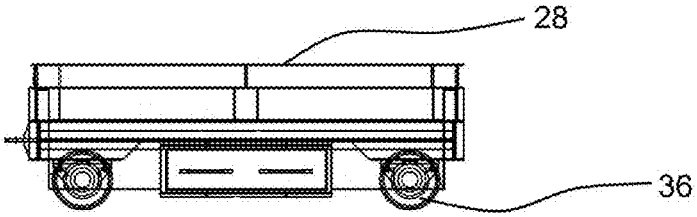

At least one, and preferably a plurality of sides 26 of the container structure define apertures 43 so as to facilitate fluid communication between the exterior and interior of the container. The longitudinal side 26*a* is depicted in FIG. 3B. The front or rear side 26*b* is depicted in FIG. 3C.

Intermediate the bottom 28 of the container 14 and the top of the container is positioned a horizontally disposed, generally flat substrate 29. This substrate is perforated so as to define a grid 17. Alternatively, a grate constructed of wire mesh or other material is so positioned. This perforated substrate 29 allows air exchange from below the structure and into the interior space defined by the container which contacts the waste. The bottom 28 of the container can be seen in FIG. 3D, while the perforated substrate 29 is depicted in FIG. 3A.

An exterior surface 34 of the container floor 28 faces downwardly, and is adapted to receive wheels, rollers or other friction-reducing embodiments. The friction-reducing embodiments may be reversibly attached to the downwardly facing exterior surface 34. The friction-reducing embodiments facilitate rolling or sliding of the MSW Container in and out of the primary chamber of the invented device using the tracks as described supra. Typically, wheels 36 are attached to the bottom of the container so as to provide clearance of the container above the floor 17 of the chamber. The container bottom 28 and the wheels 36 attached thereto can be seen in FIGS. 3D-F.

A salient feature of this embodiment of the container is a plurality of vertically disposed channels 38 which extend upwardly from the intermediate floor 29 of the container for substantially the useable height "h" of the container. The channels 38 are perforated along their lengths so as to provide a means of fluid exchange between the atmosphere of the gasifying chamber and interior regions of waste collected in the container.

Figure 4A:
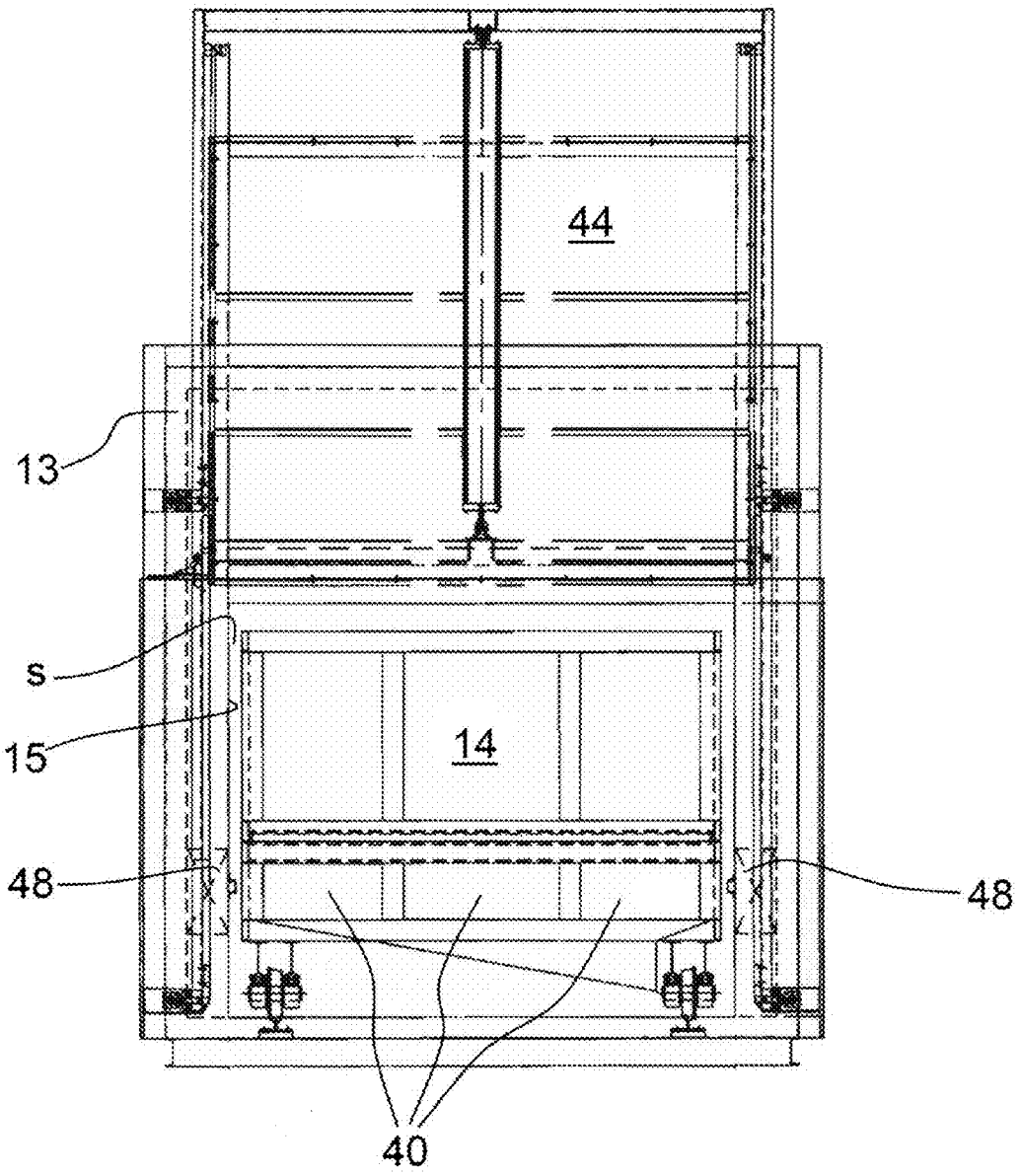
FIG. 4A a view of FIG. 1 taken along line 4-4.
Figure 4B:
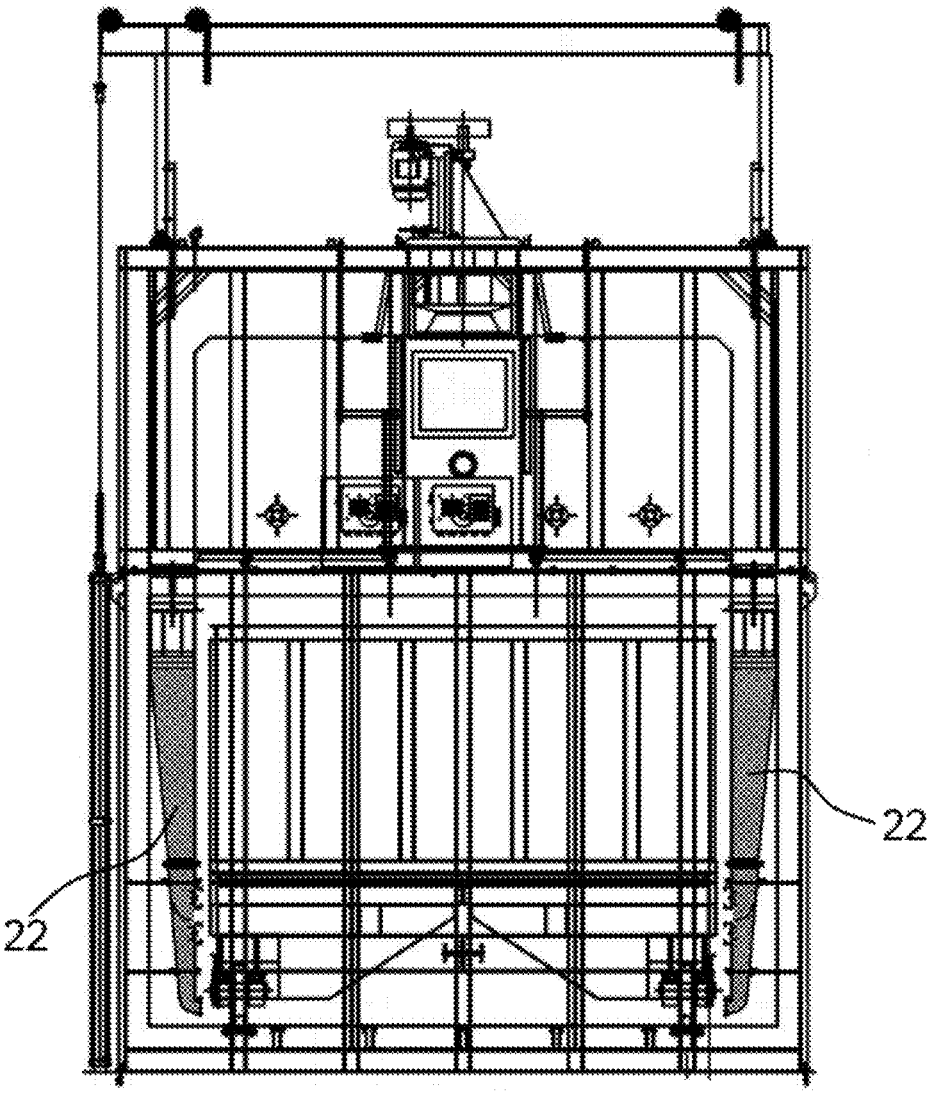
FIG. 4B depicts the heated air conduit as a shaded region, in accordance with features of the present invention.

The container 14 depicted in FIG. 4A also features a plurality of sumps 40 to serve as a means for collecting solid-phase recyclables, which form and drop to the bottom of the sumps 40 as a consequence of gravity, during thermal treatment of waste.

The intermediate floor 29 is similar to the grid structure of the floor 28 and is positioned between the floor 28 and the top 24 of the container 14. The intermediate floor 29, the floor 28, and the sides 26 of the container 14 define a space 42 which extends substantially underneath the entire intermediate floor 29. The periphery of the space 42 defines the aforementioned apertures 43, adapted to receive high temperature fluid, such as heated air confined to the gasification chamber. The high temperature fluid permeates upwardly through the bulk of the garbage, and through the channels 38. The perforations in the channels 38 provide additional means for facilitating fluid communication between interior regions of the waste and the high temperature fluid.

FIG. 1 depicts the container 14 of FIG. 3 in phantom, positioned in the gasification chamber 12.

FIG. 4A is a view of FIG. 1 taken along line 4-4. The system 10 is depicted in FIG. 4A with a container-access door 44 in an open position. The vertically oriented door 44 is illustrated as being in slidable communication with a wall 13 of the gasification chamber 12. However, other configurations are suitable, such as a top loading design wherein the door is horizontally disposed and in slidable and/or hingeable communication with aspects of the gasification chamber.

Heated Fluid

Circulation Detail

As can be noted in FIG. 4A, the container 14 is received by the gasification chamber 12 such that a predetermined space "s" exists between the interior walls 15 of the chamber 12 and the container once the container is fully nested inside the chamber. A plurality of medially-directed baffles 48 are positioned intermediate the interior walls 15 and the exterior side walls of the container. The baffles 48 are depicted attached to and extending from the interior walls 15 of the gasification chamber. The baffles 48 frictionally engage with the exterior sides of the container so as to direct heated fluid, generated from superior regions of the chamber (those regions proximal to the heating elements), through the space "s" defined by the container and interior chamber walls 15, through the apertures 43, and into the region 42 of the container that is positioned below the waste-support structure of the container that is defined by the perforated substrate 29. The baffles are elongate in configuration and extend along a portion of the interior chamber walls 15.

As depicted in FIG. 5, heating elements 46 are positioned above the container. The heating elements 46 are either mounted to surfaces of the interior chamber walls 15 or else mounted to a ceiling portion 17 of the gasification unit. A suitable voltage is applied to the elements to allow the gasification chamber to attain a temperature of 1300° F. in less than 1 hour, and usually within 30 minutes. The inventors have found tubular heaters to be suitable as the heating element 46. Specifically, a tubular heater with an Incoloy sheath was found to provide the level of heat necessary to oxidize the waste constituents. The heating elements 46 are also arranged in an overlapping configuration, similar to bowling pins, so as to ensure that the incoming gas is properly heated to react with the waste constituents. However, other arranges for the heating elements 46 are easily envisioned, including parallel rows, overlapping weaves, and conical coils to name a few.

As depicted in FIG. 1, a region of the gasification chamber defines a means of air ingress 50. While the illustrated embodiment depicts a region of the top of the gasification chamber forming an aperture as the means of air ingress, ingress points are suitable anywhere around the chamber.

Figure 7:
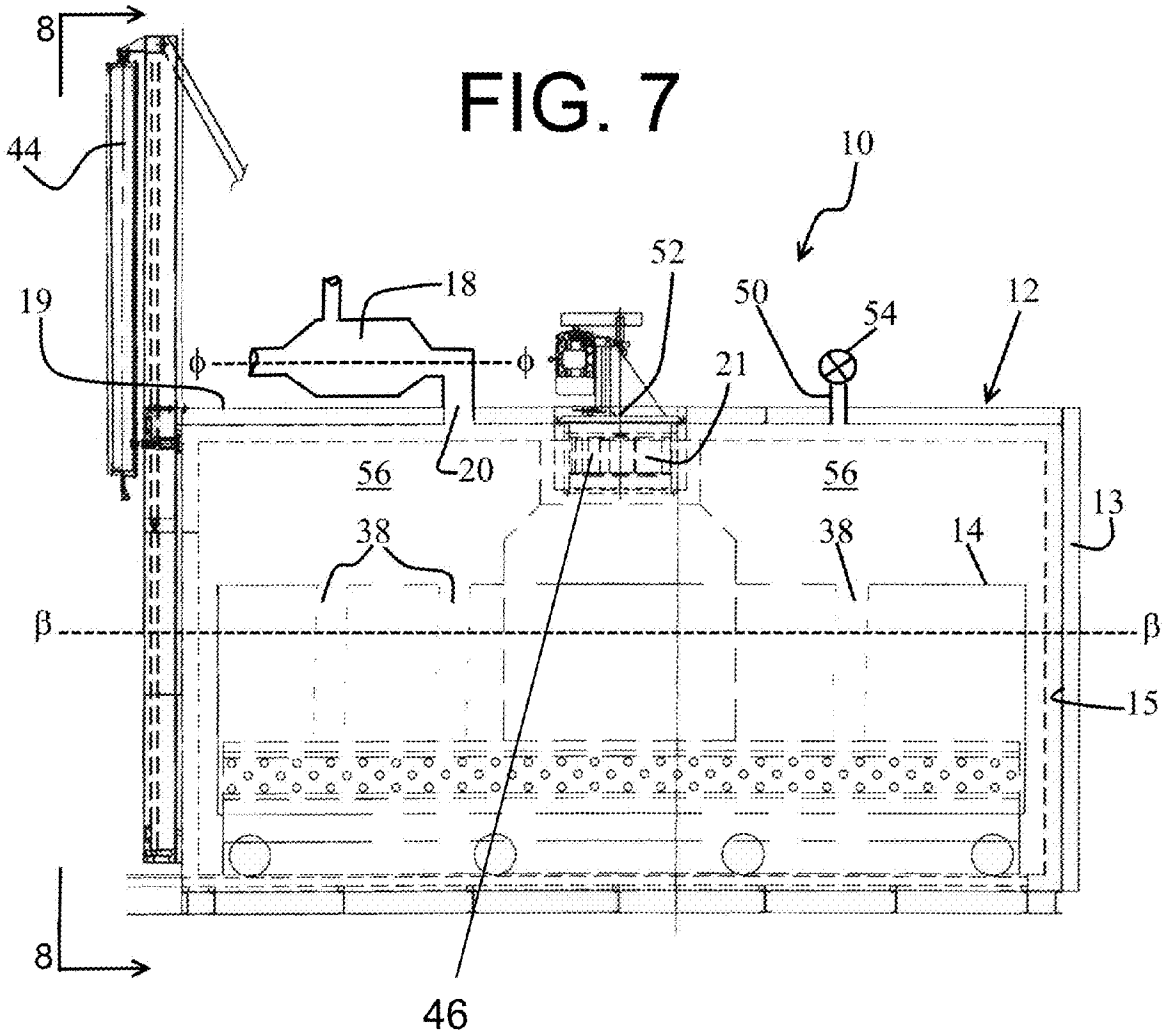
FIG. 7 is an elevational schematic view of an alternative embodiment of the gasification system, in accordance with features of the present invention.
Figure 8:
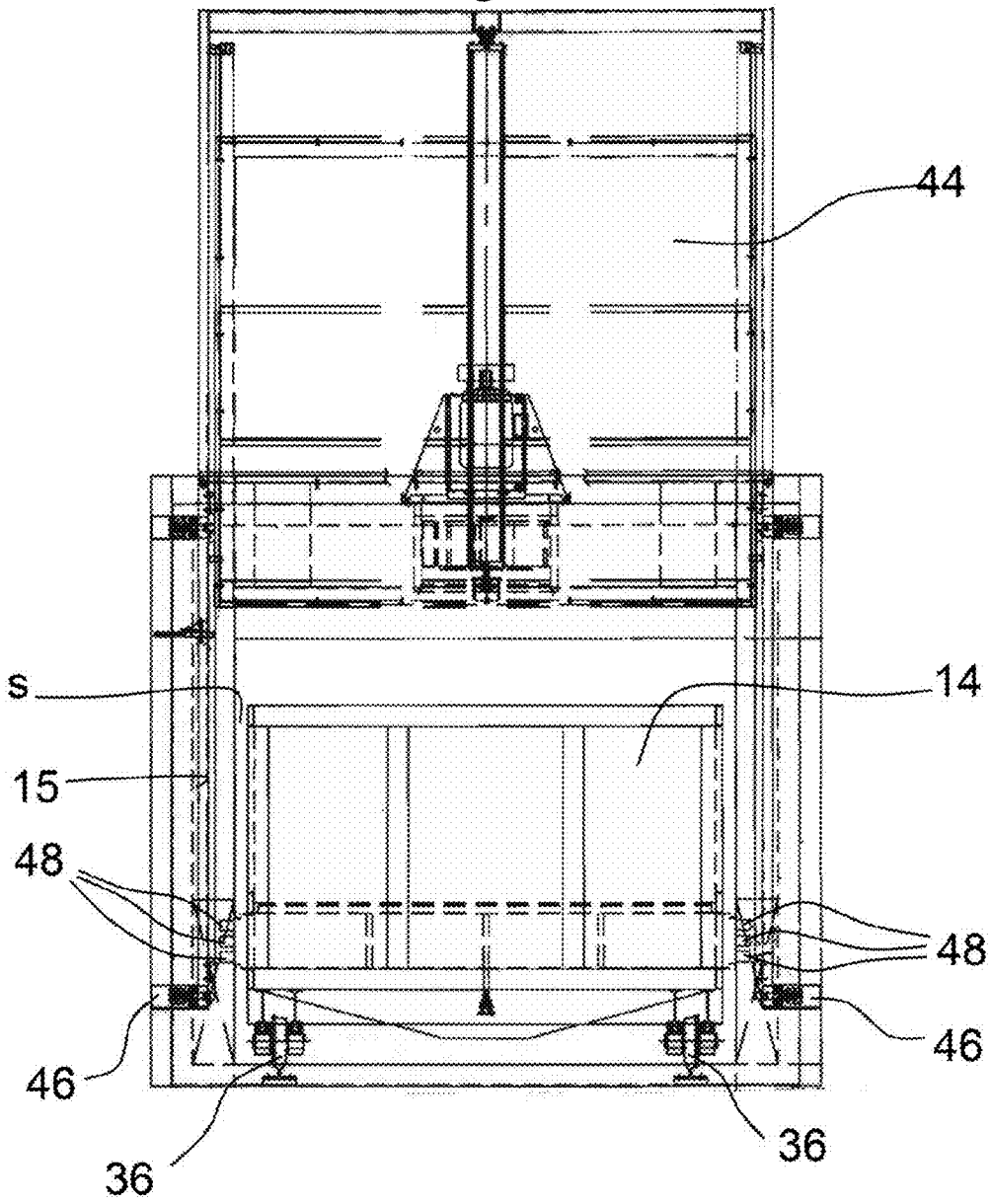
FIG. 8 is a few of FIG. 7 taken along line 8-8.
Figure 9A:
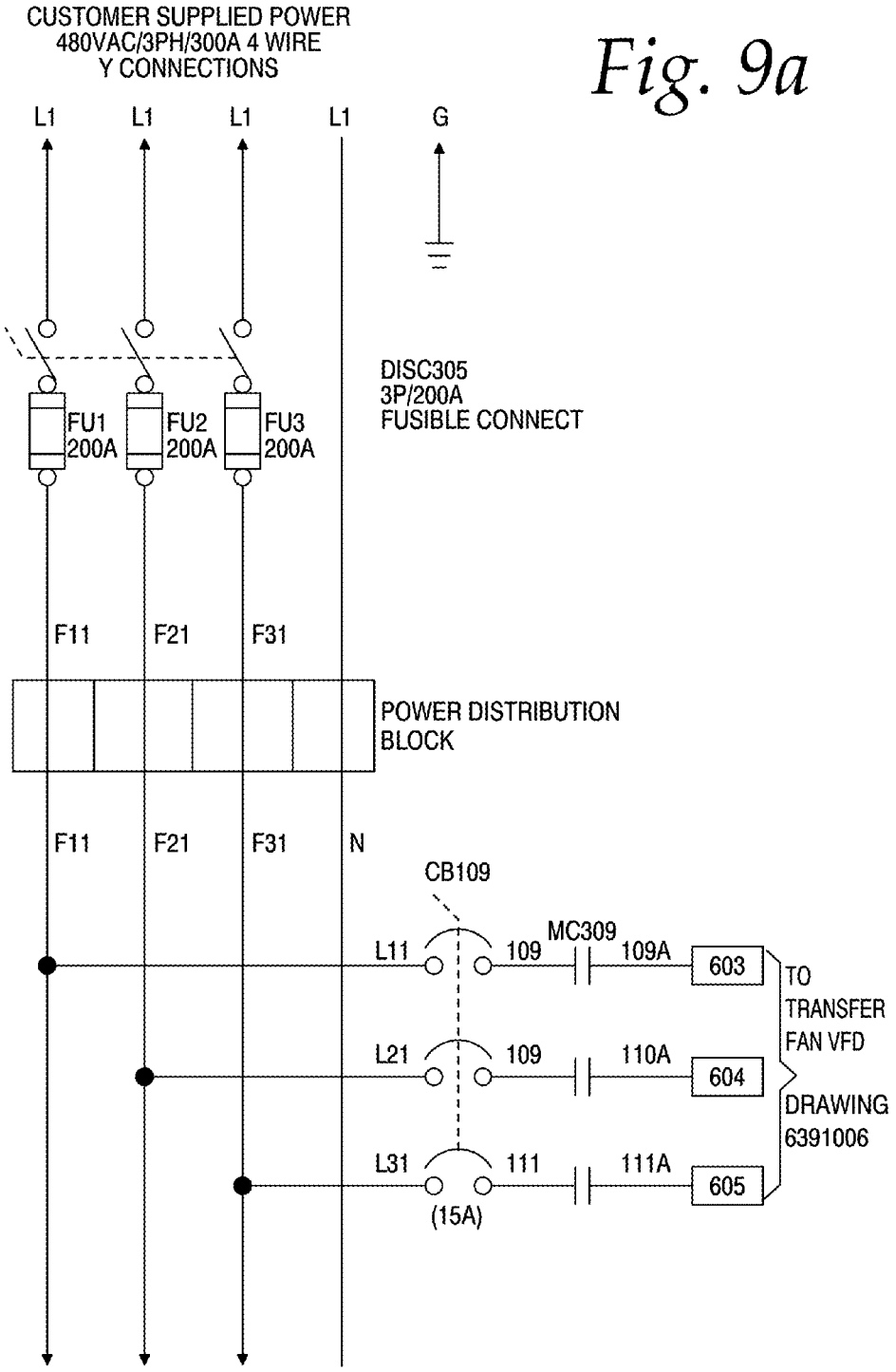
FIGS. 9*a-c* are a schematic depiction of the waste gasification unit power input.
Figure 9B:
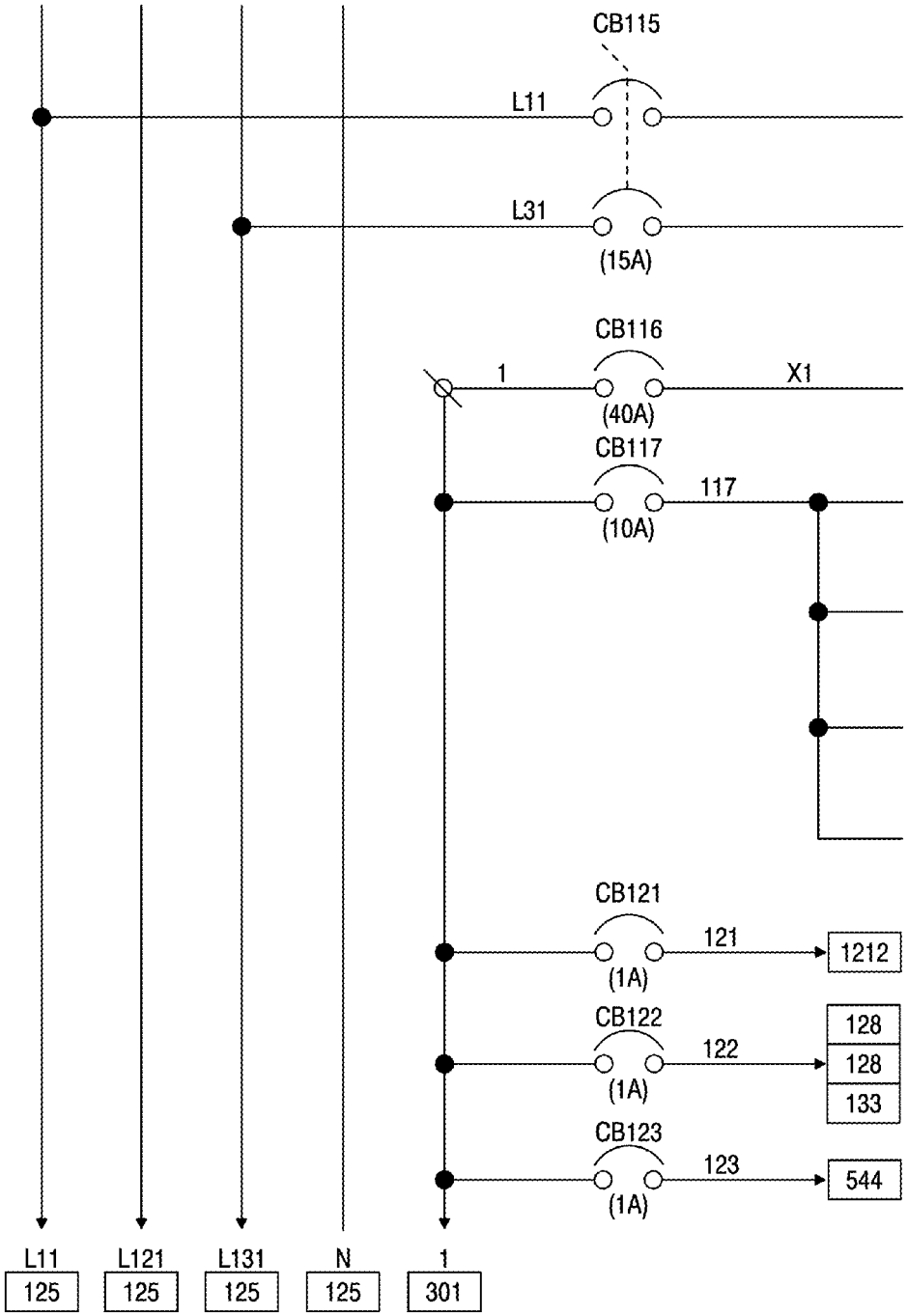
Figure 9C:
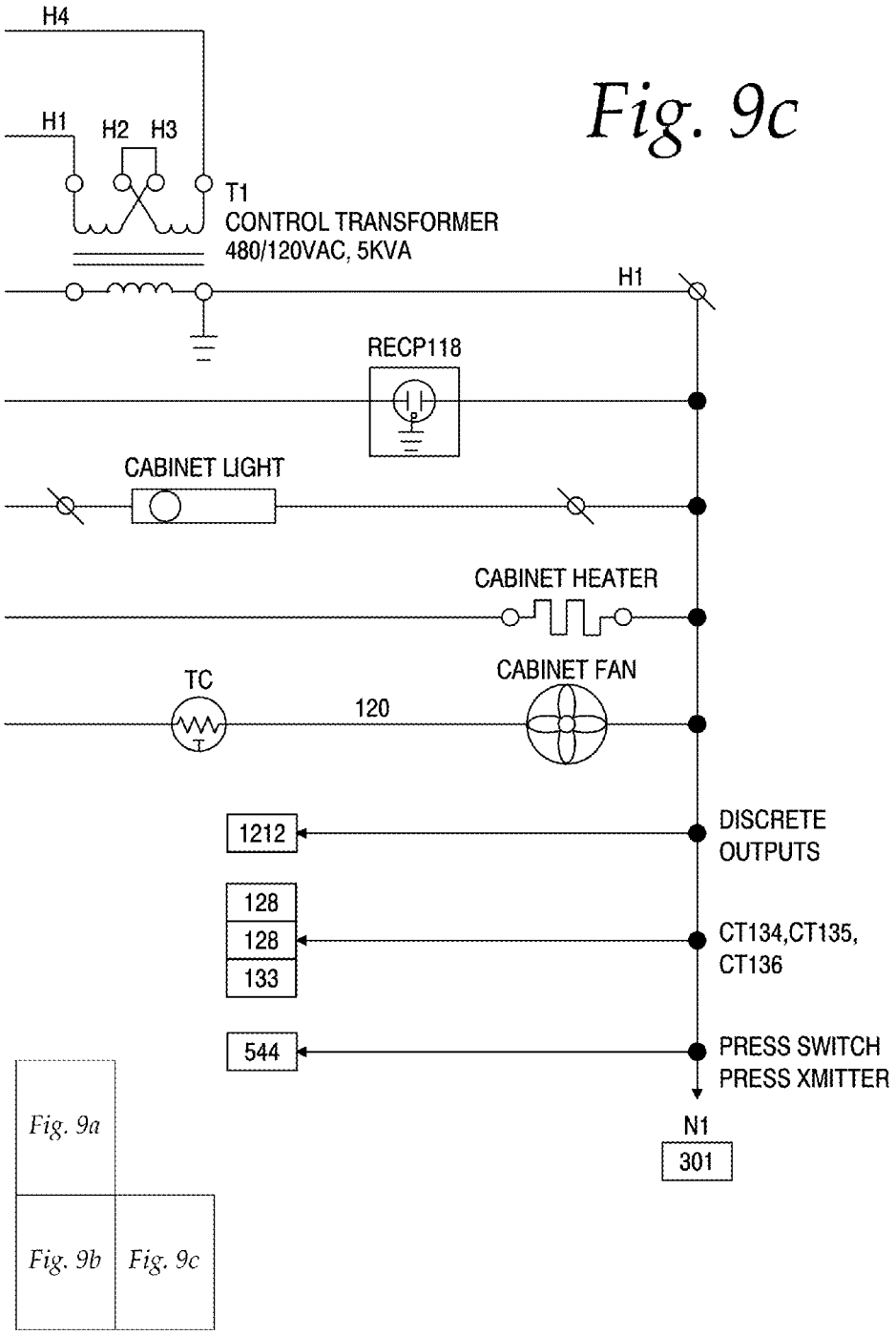
Figure 10A:
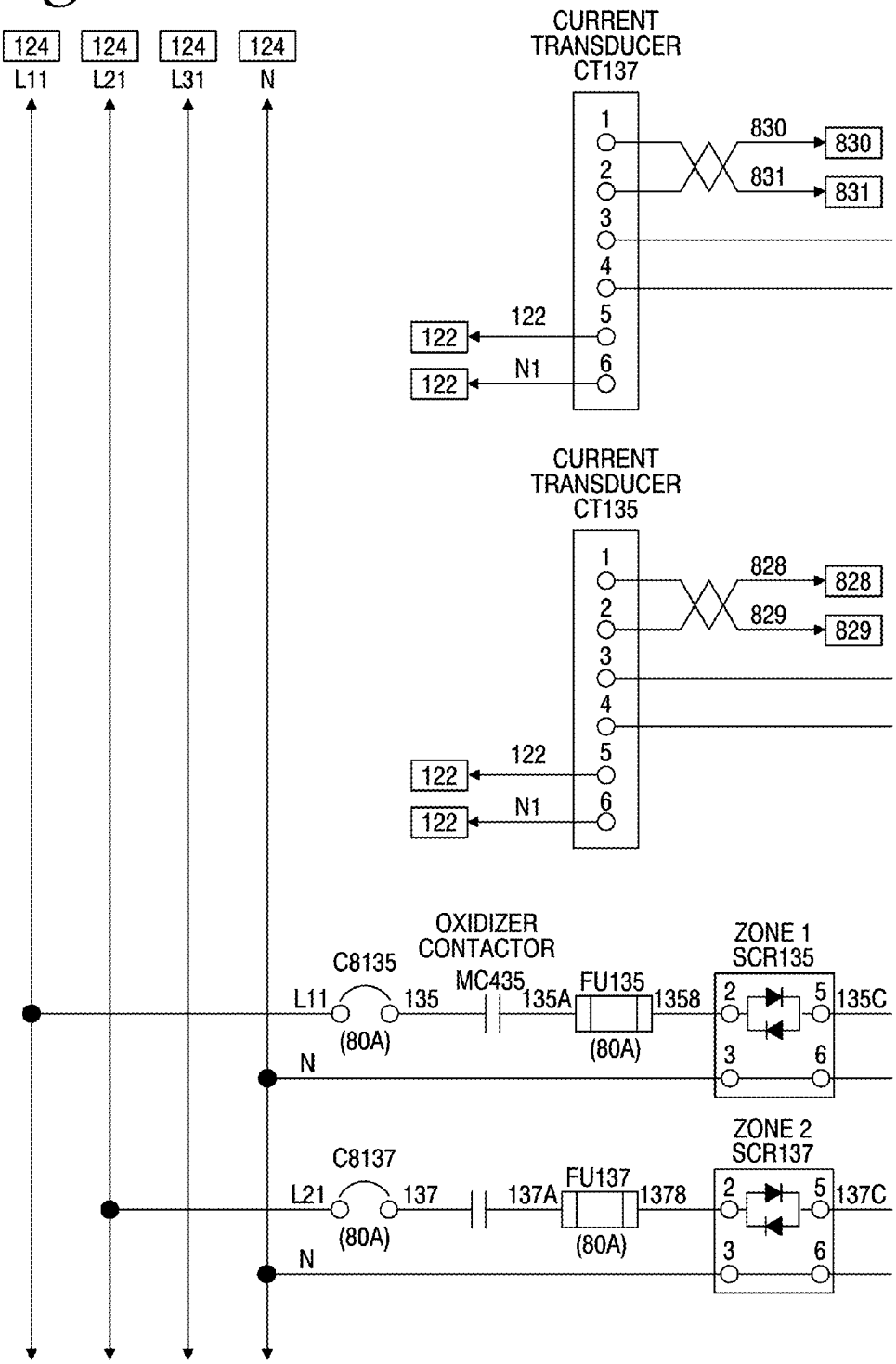
FIGS. 10*a-d* are a schematic depiction of the oxidizer and gasifier heaters.
Figure 10B:
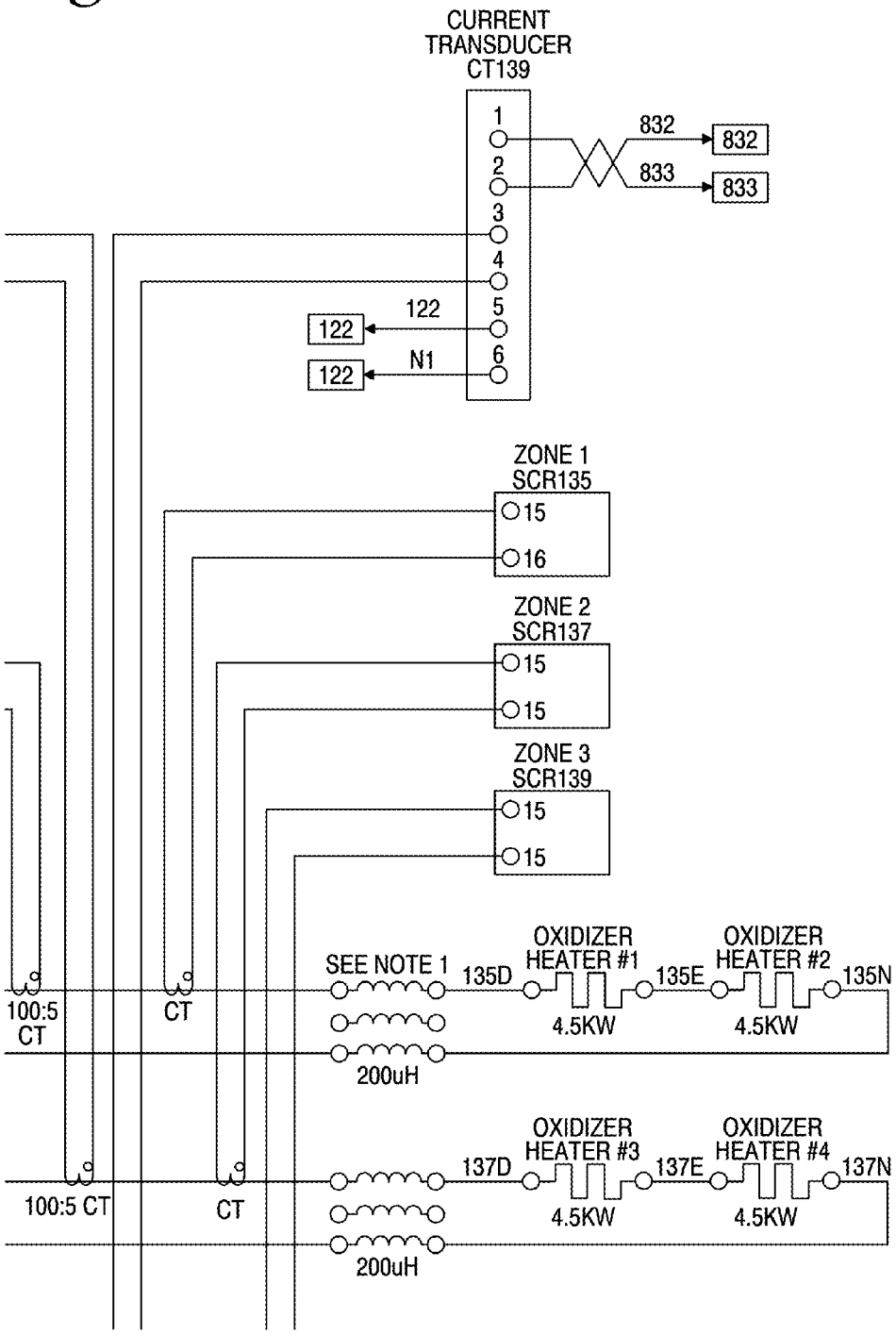
Figure 10C:
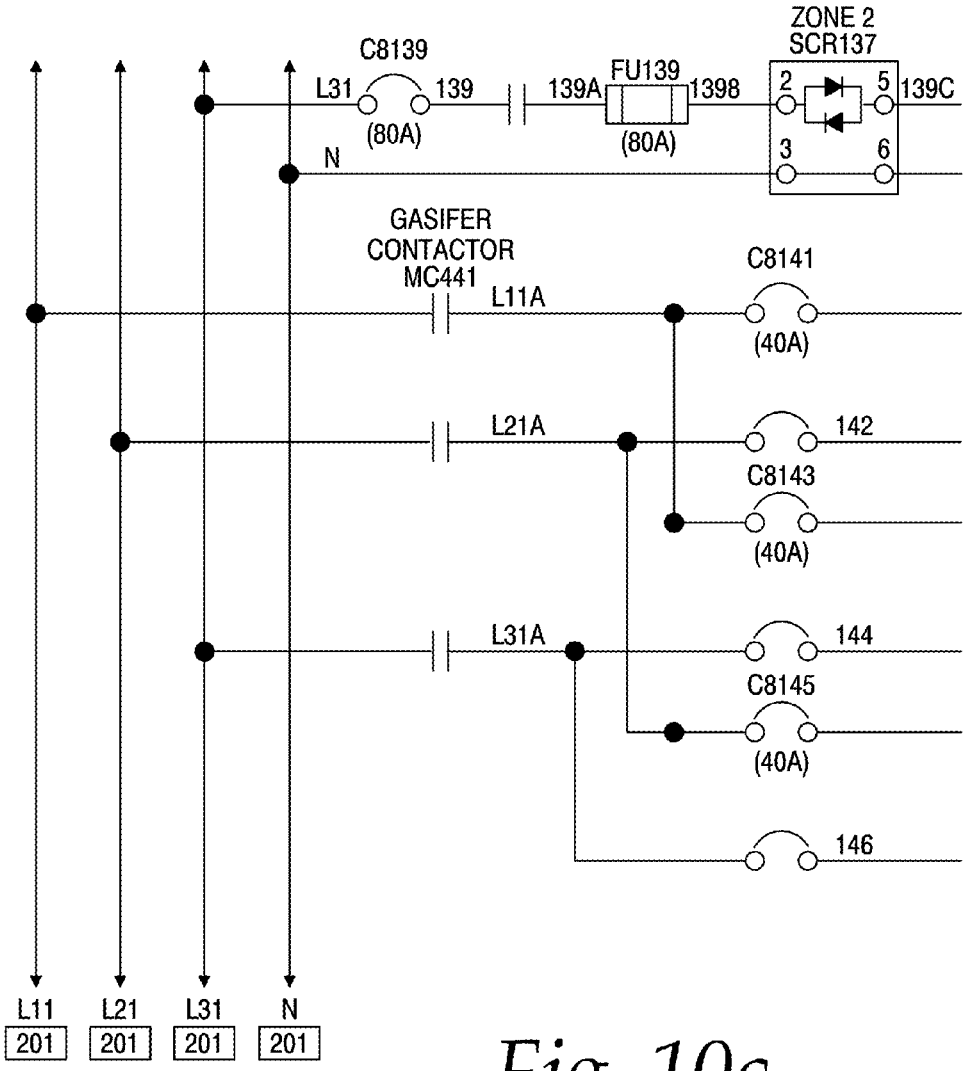
Figure 10D:
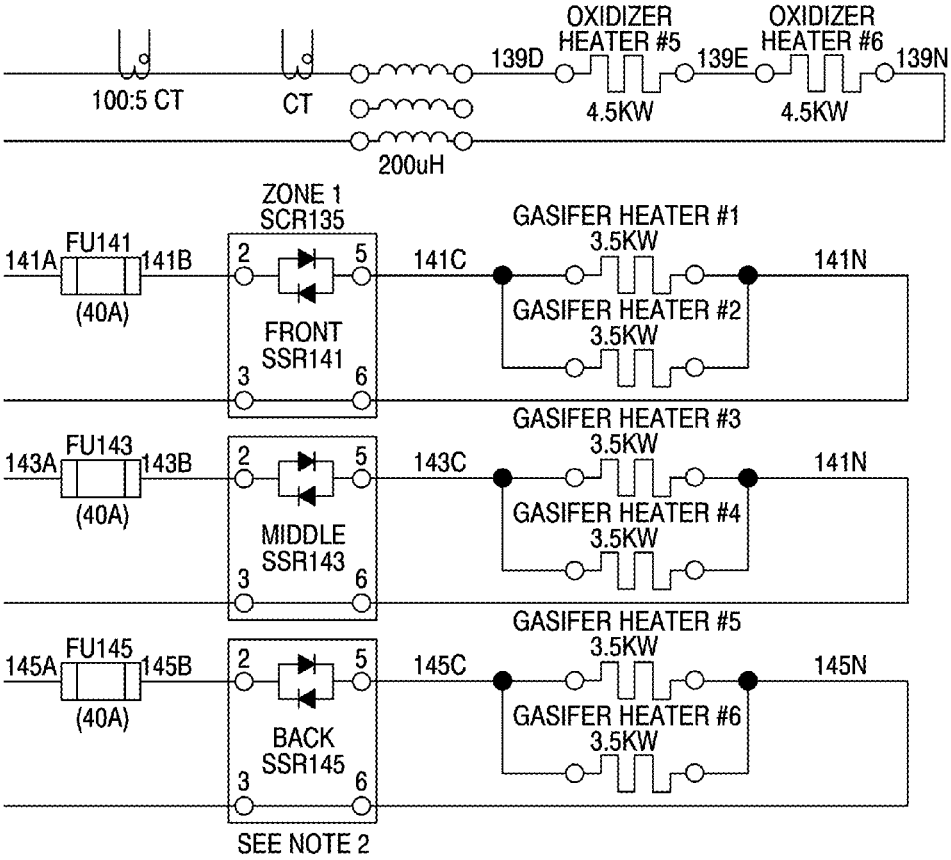
Figure 11A:
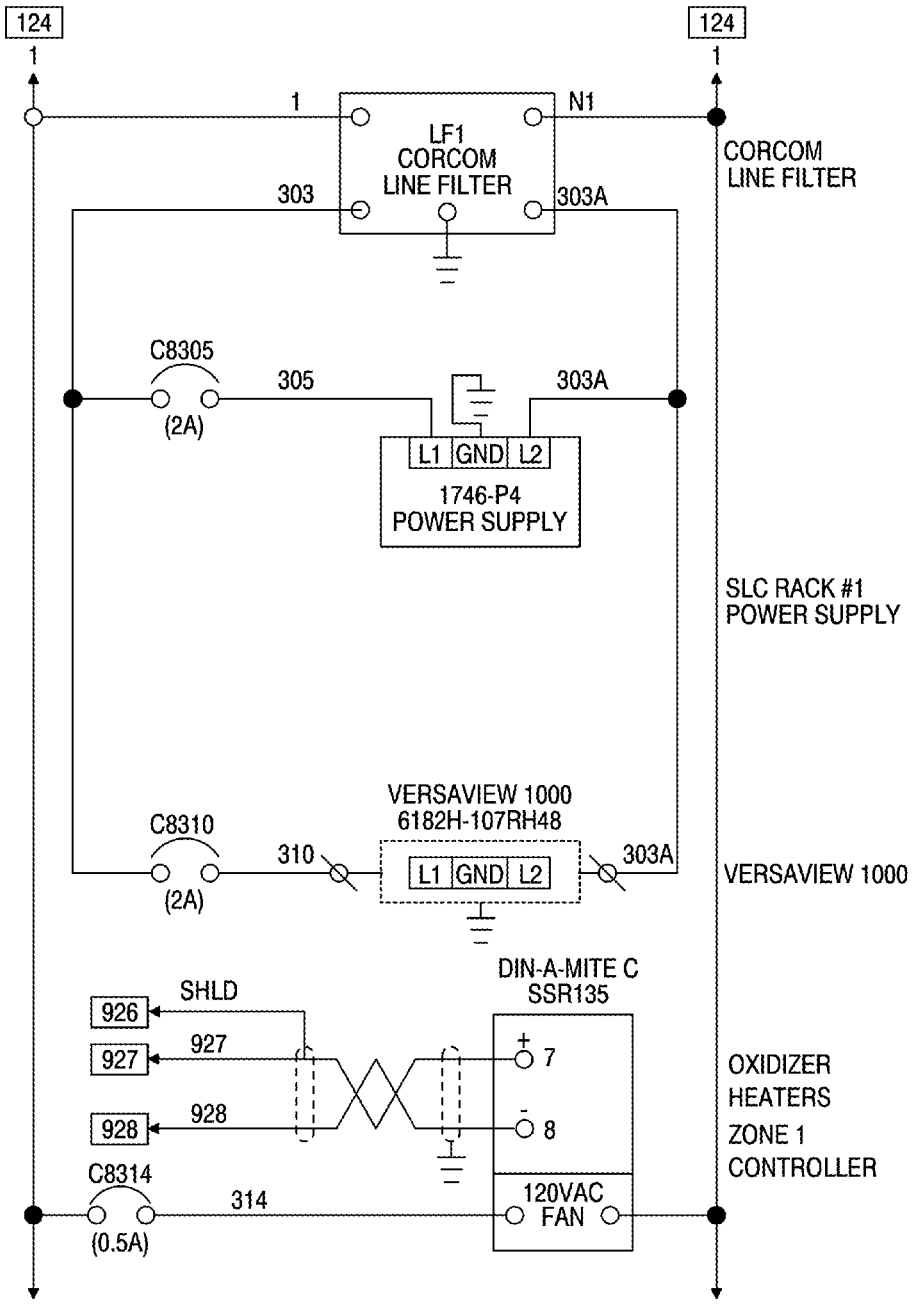
FIGS. 11*a-b* are a schematic depiction of the oxidizer heaters power controllers and NC power supply.
Figures 11A, 11B:
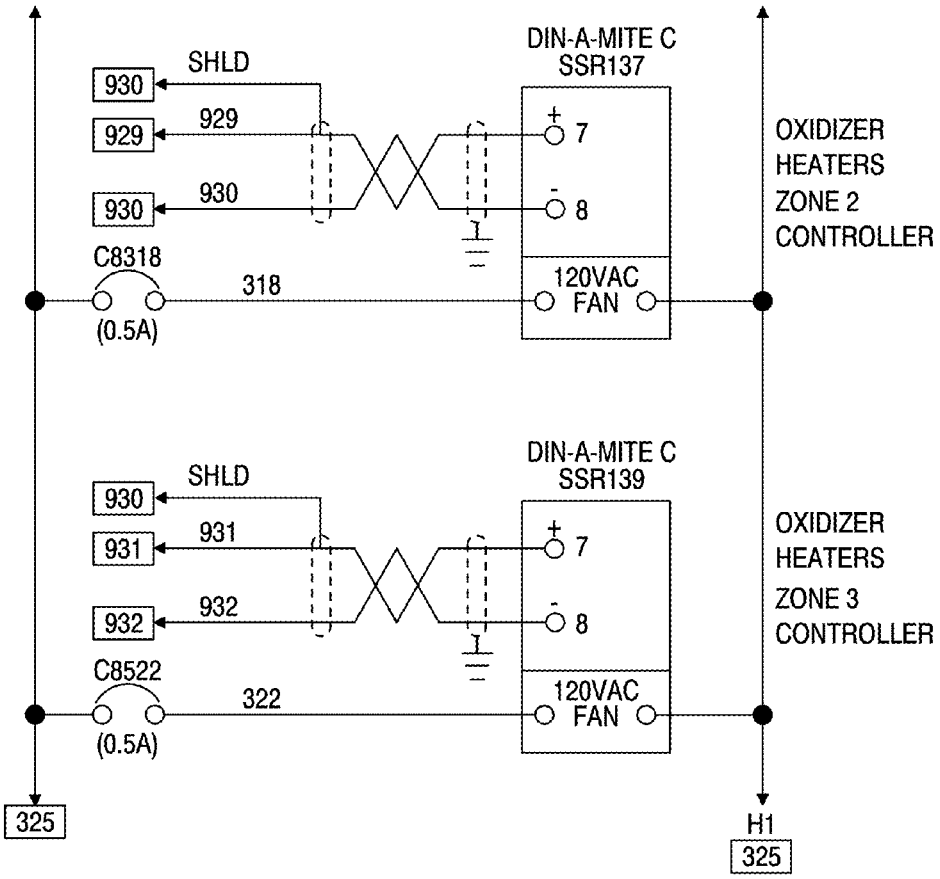
Figure 12A:
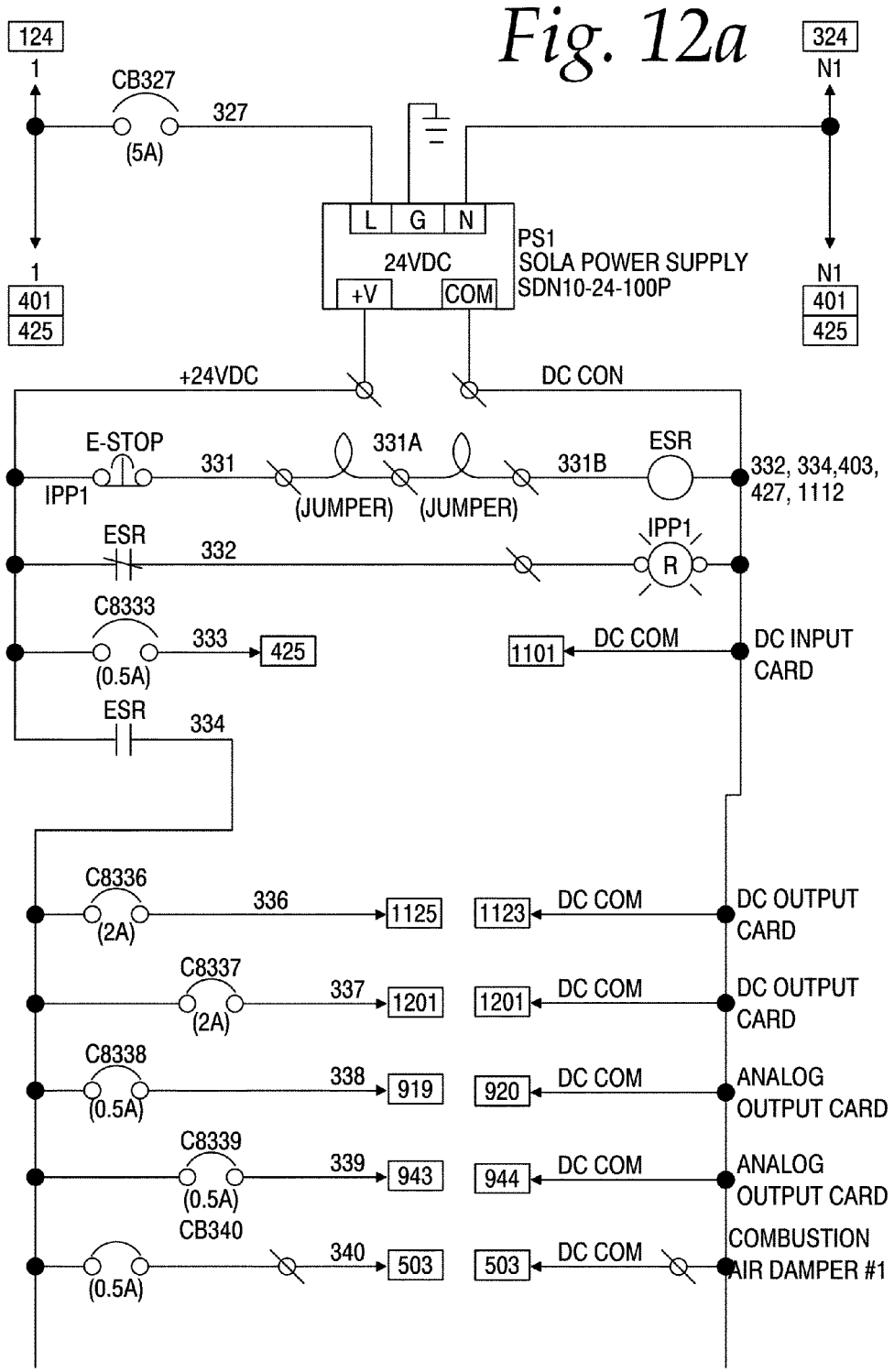
Figure 13:
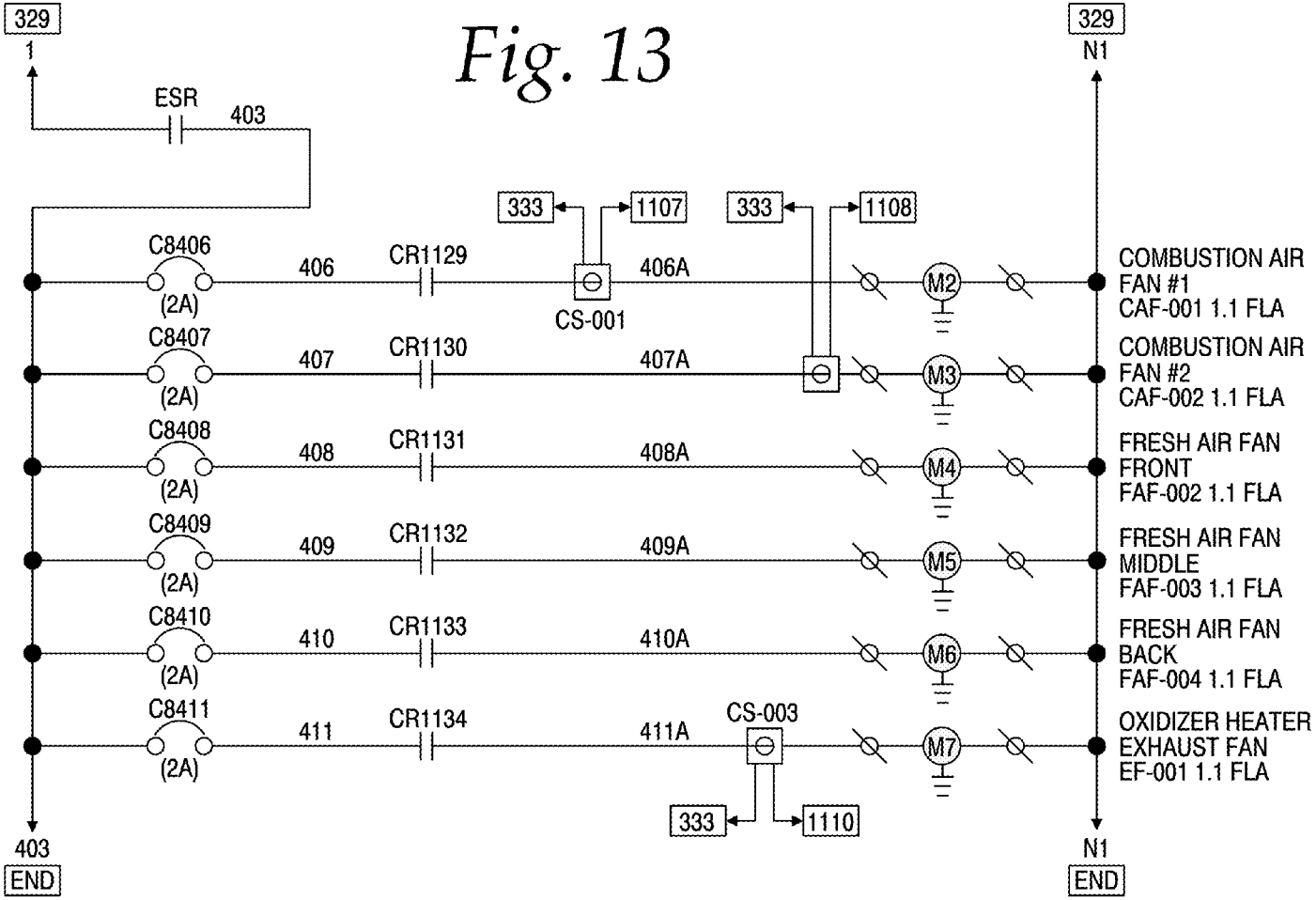
FIG. 13 is a schematic depiction of the combustion and fresh air fans and the oxidizer heater exhaust.
Figure 14A:
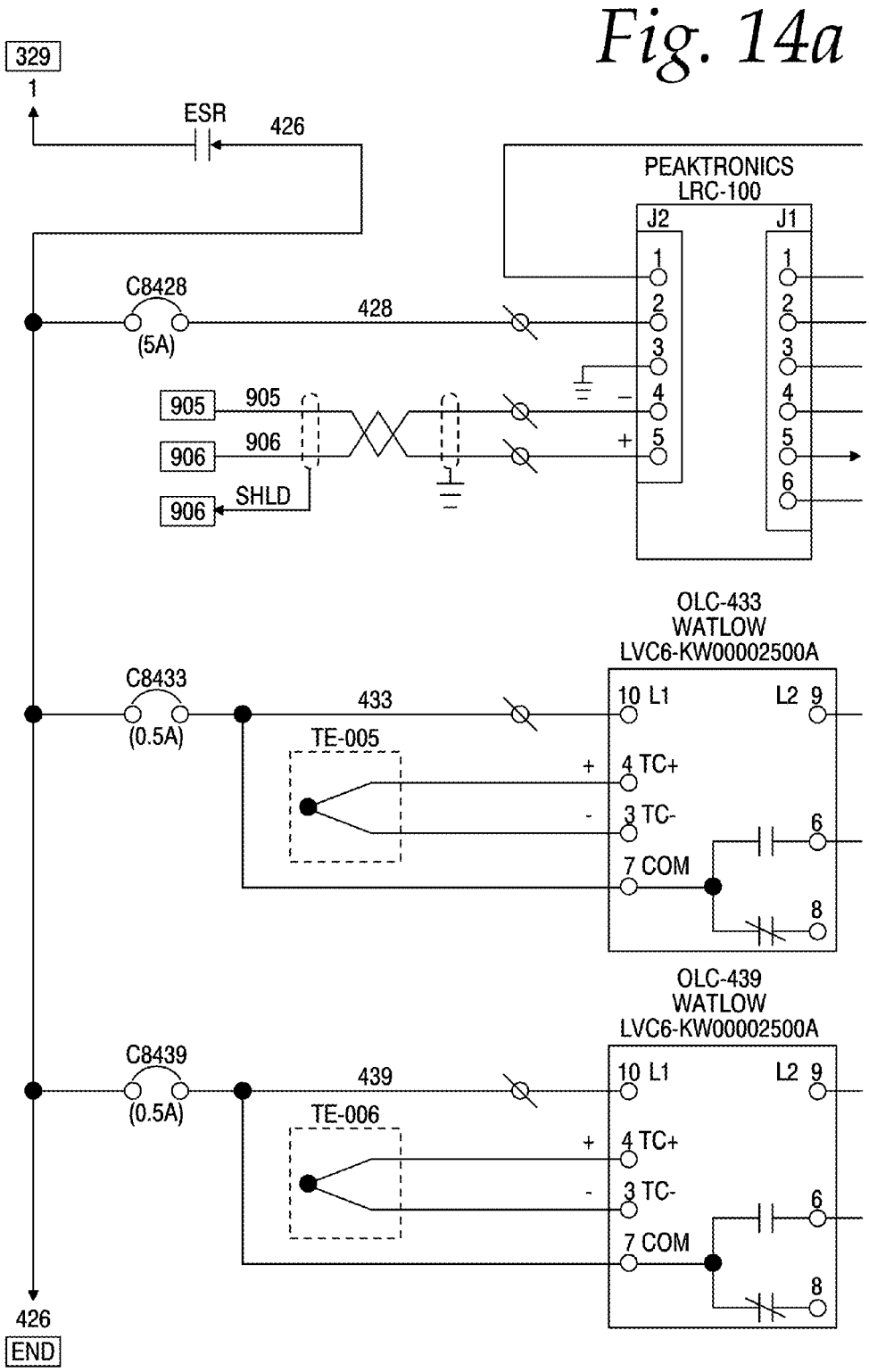
FIGS. 14*a-b* provide a schematic representation of the oxidizer inlet valve controller with the oxidizer and gasifier high limit temperature controllers.
Figures 14A, 14B:
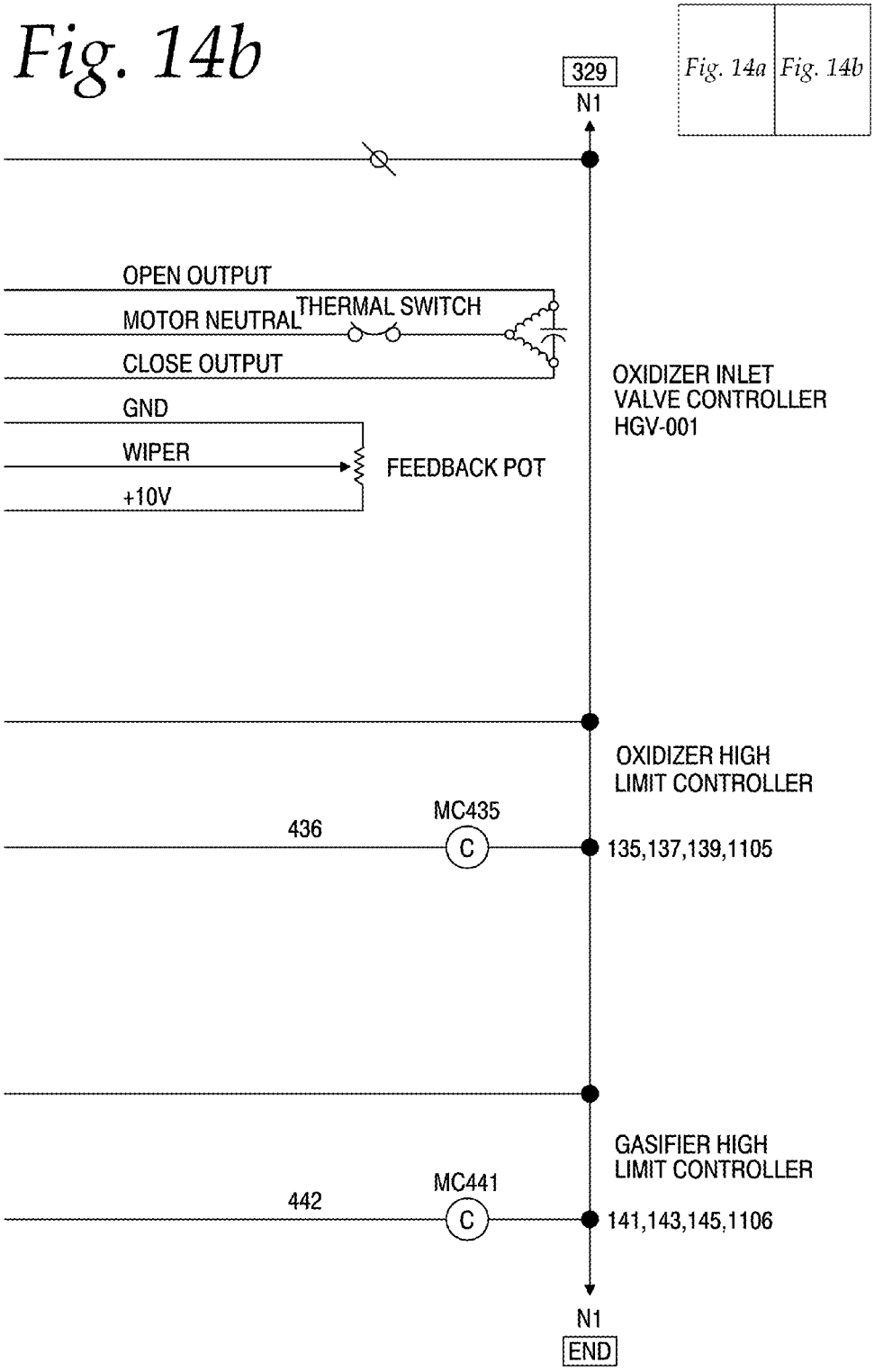
Figure 16A:
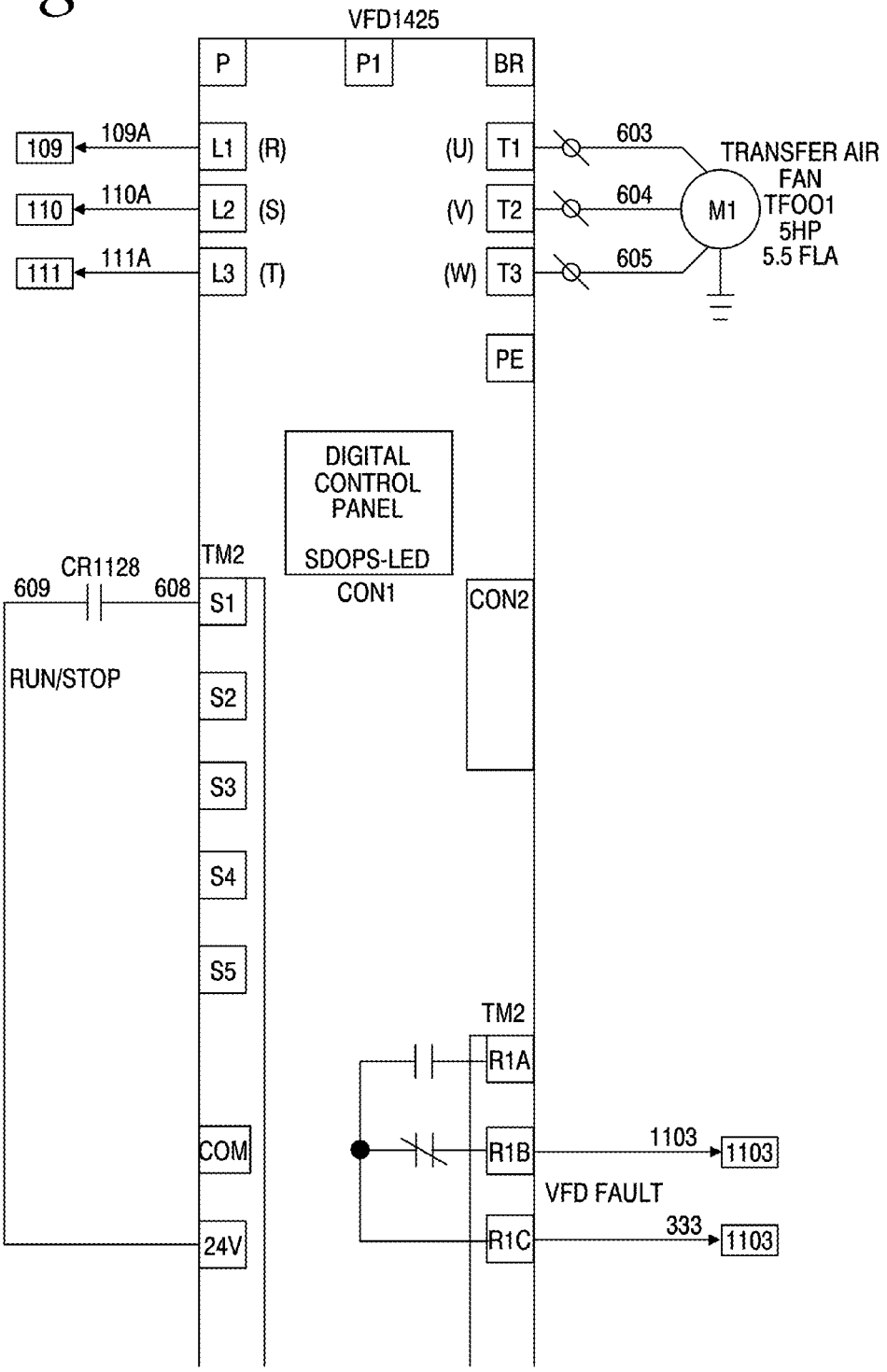
FIGS. 16*a-b* are a schematic depiction of a transfer fan and its control circuitry, in accordance with features of the present invention.
Figures 16A, 16B:
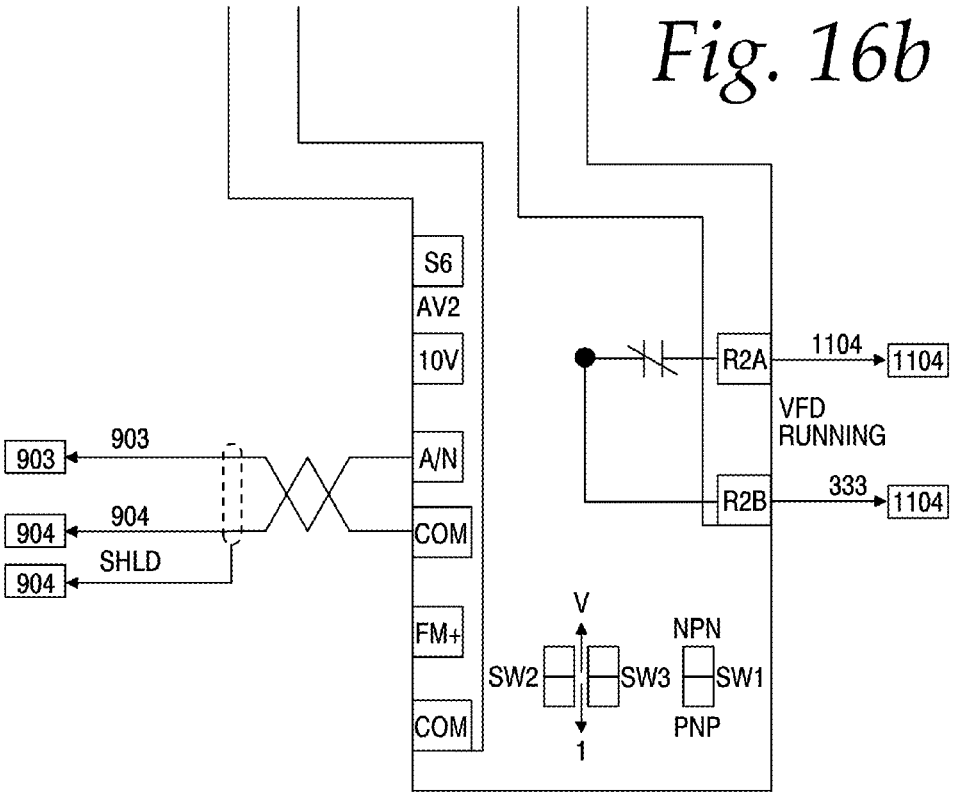

Turning to the side view of the gasification chamber, FIG. 7, a plurality of air ingress means 50 are linearly disposed along the longitudinal axis 13 of the ceiling of the gasification chamber. Means 54, such as valves, for regulating flow of air through the ingress means 50 are provided, inasmuch as a crucial aspect of the invented method is regulating oxygen content of the atmosphere of the gasification chamber 12, as noted supra. In an embodiment of the invention, each air ingress means 50 comprises a thermocouple-controlled valve and a fresh air fan such that each air ingress means 50 operates independent from others.

FIG. 5 shows a plurality of heating elements 46 positioned at or proximal to the ceiling of the gasification chamber. An embodiment of the invention is an in-line configuration of heating elements 46.

A circulation fan 52, or a plurality of fans, positioned at or near the top of the headspace 56 of the gasification chamber provides continuous turbulence so as to facilitate homogeneous mixing of heated fluid throughout the chamber during thermal degradation of the waste. A feature of this forced-air system is that the heating elements are located proximal to air intakes.

Waste Heat

Generator Detail

FIG. 6 depicts a secondary treatment module of the invented system, the secondary treatment module heretofore described as the waste heat generator 18. The waste heat generator 18 is positioned in close spatial relationship to the gasification chamber 12, and particularly in close spatial relationship to the means of egress 20 of the gas produced in the process. FIGS. 1 and 7 show the waste heat generator 18 supported by an upwardly facing exterior surface of the chamber.

Figure 26:
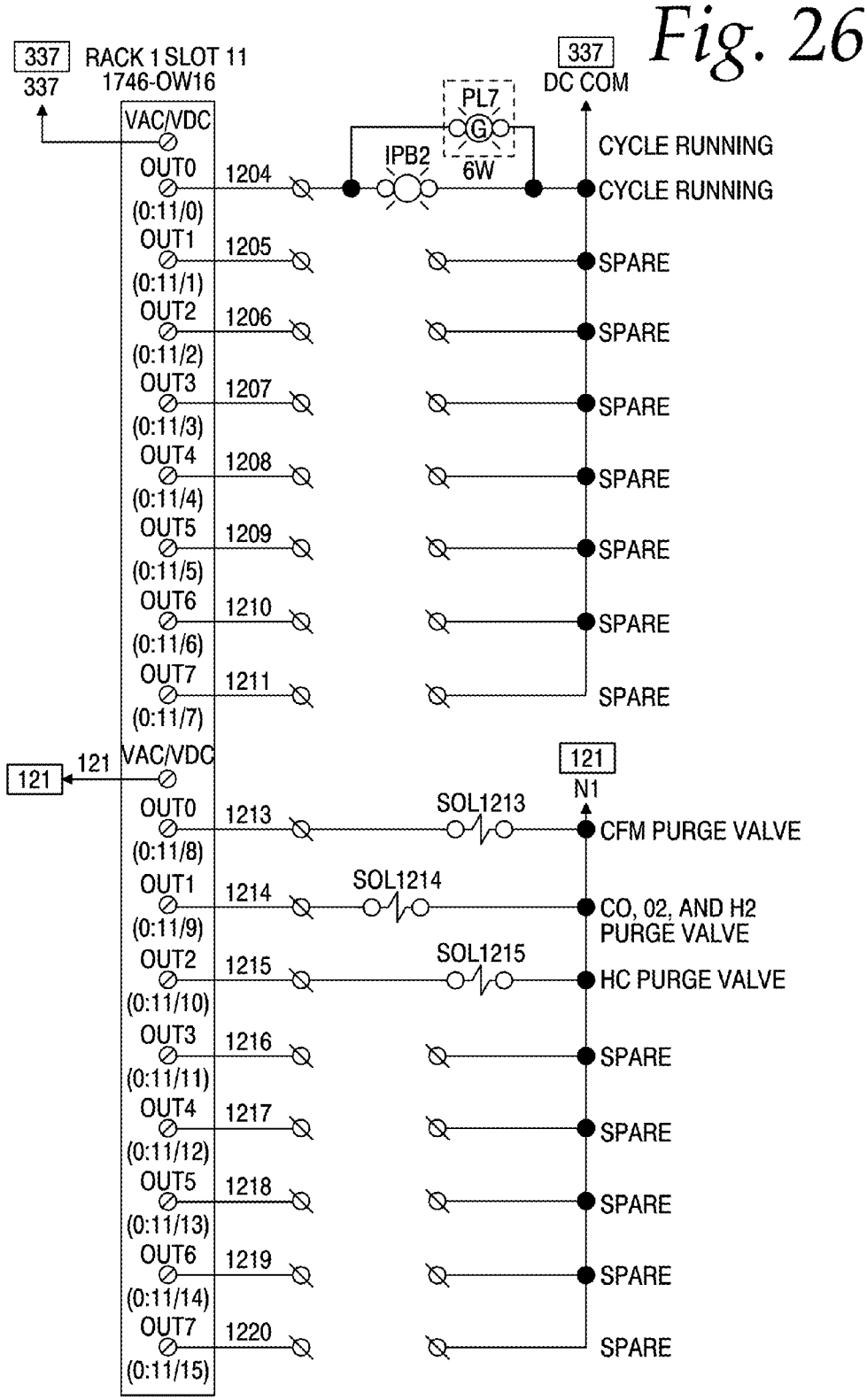
FIG. 26 is a schematic depiction of the programmable controller output to the green "cycle running" lights and the solenoid gas purge valves.
Figure 27B:
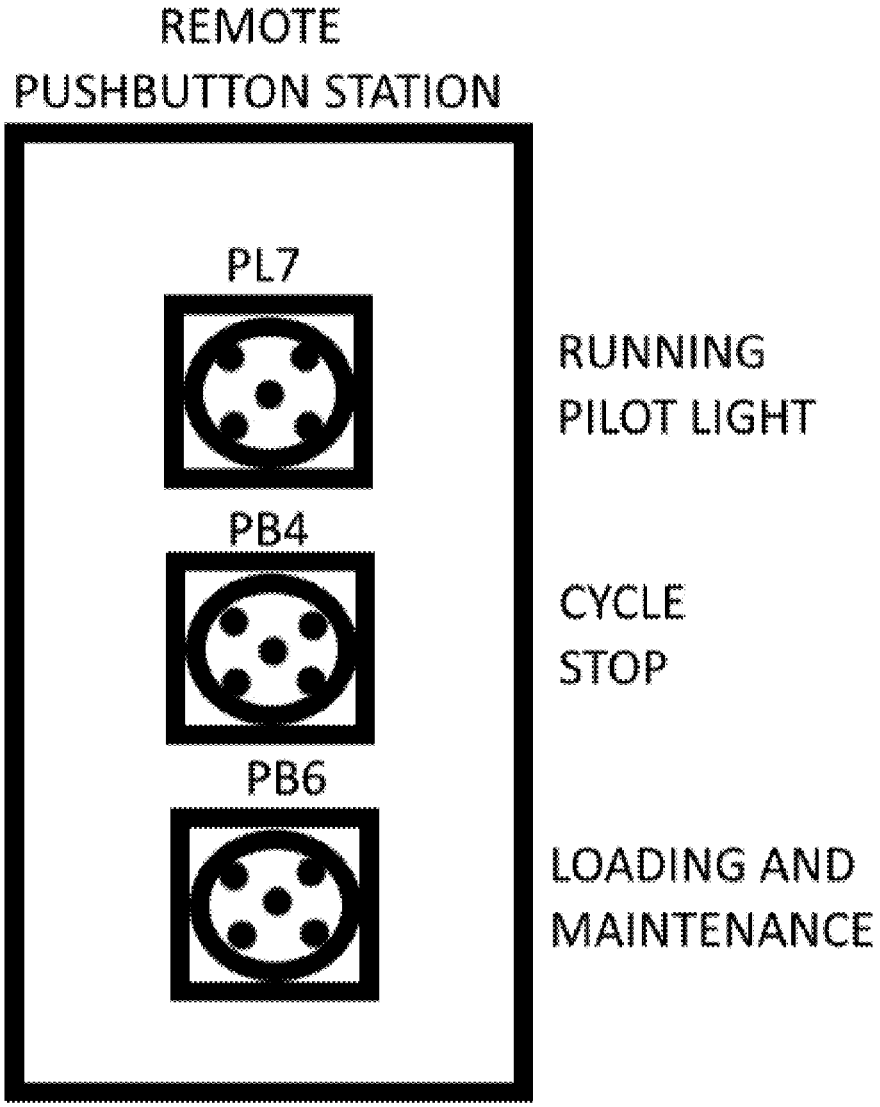
FIG. 27B depicts a remote controller.
Figure 28:
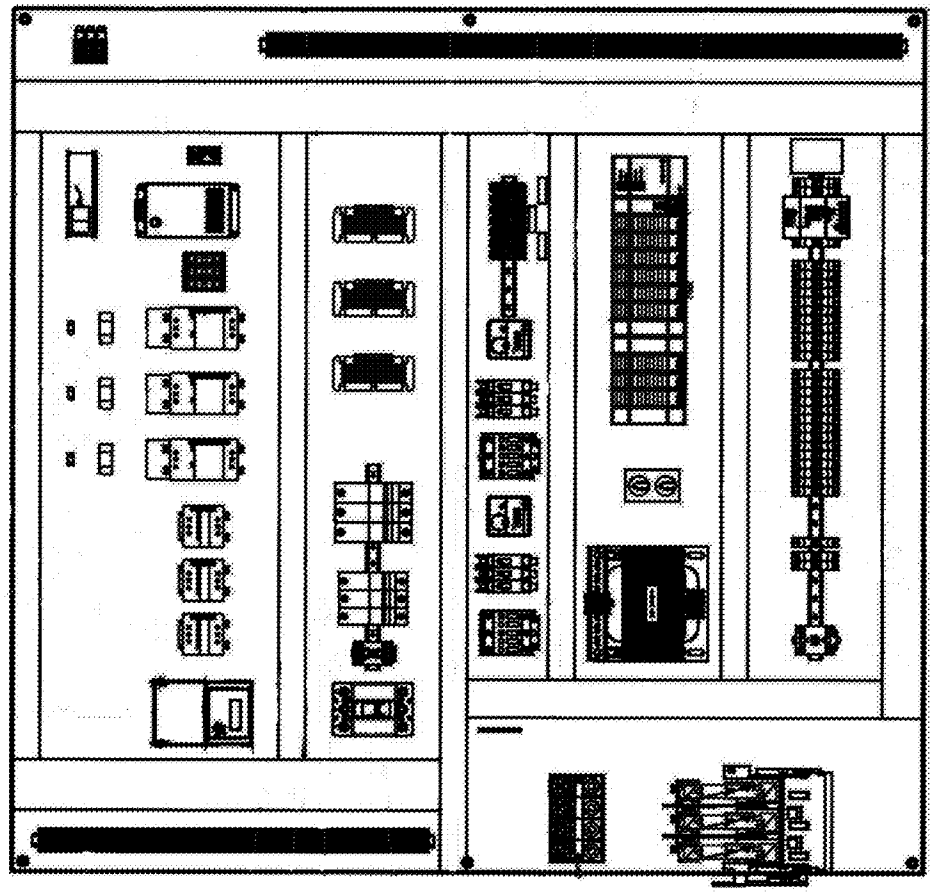
FIG. 28 is an electronic component panel.
Figure 29A:
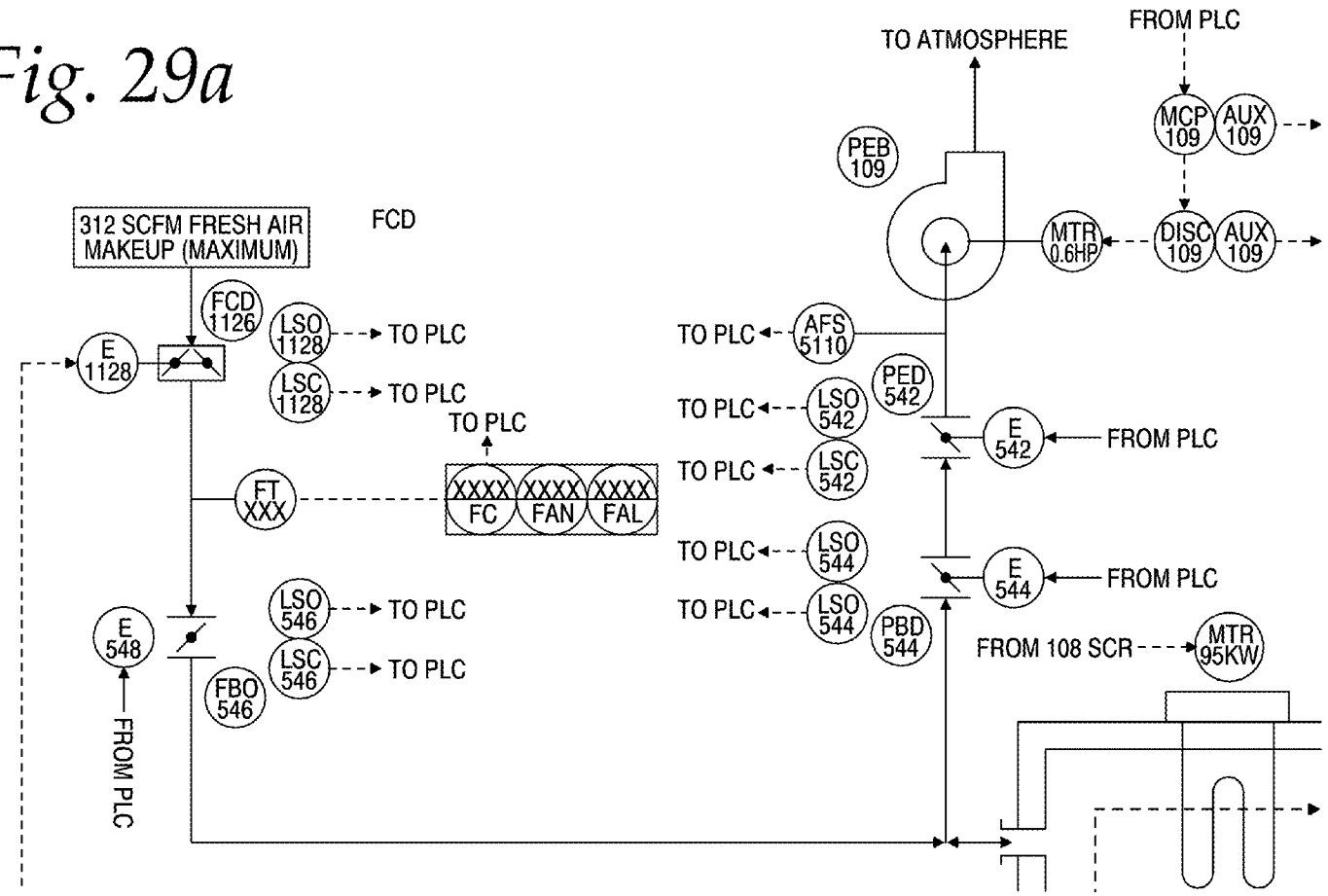
FIGS. 29*a-e* are a schematic representation of the airflow in the gasifier chamber and of the operational components.
Figure 29B:
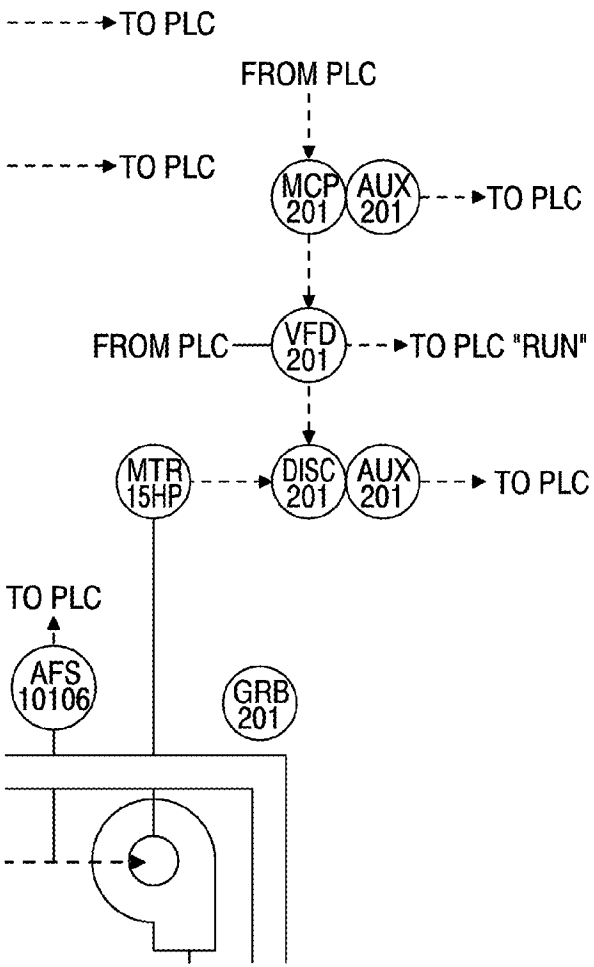
Figure 29C:
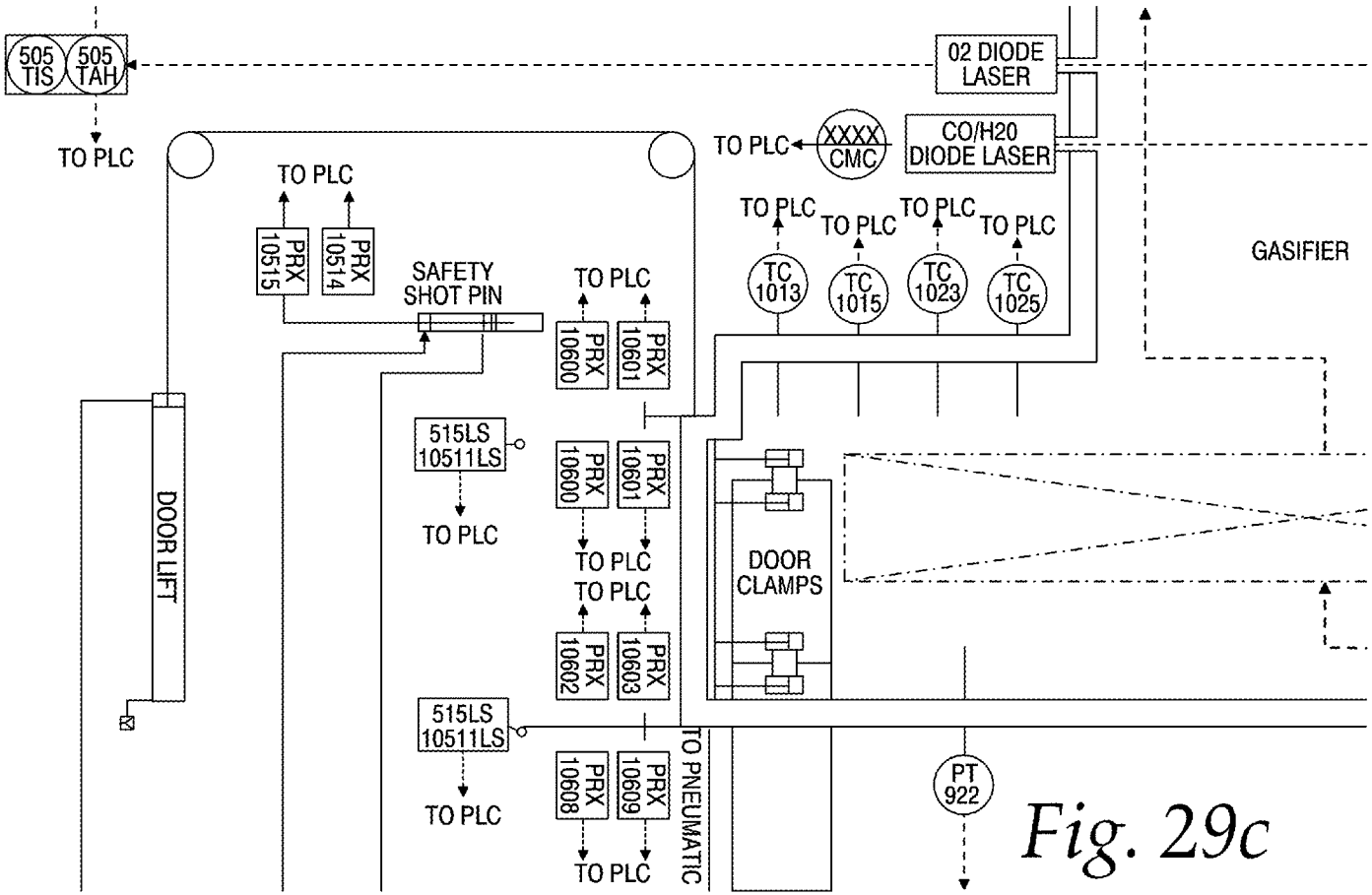
Figure 29D:
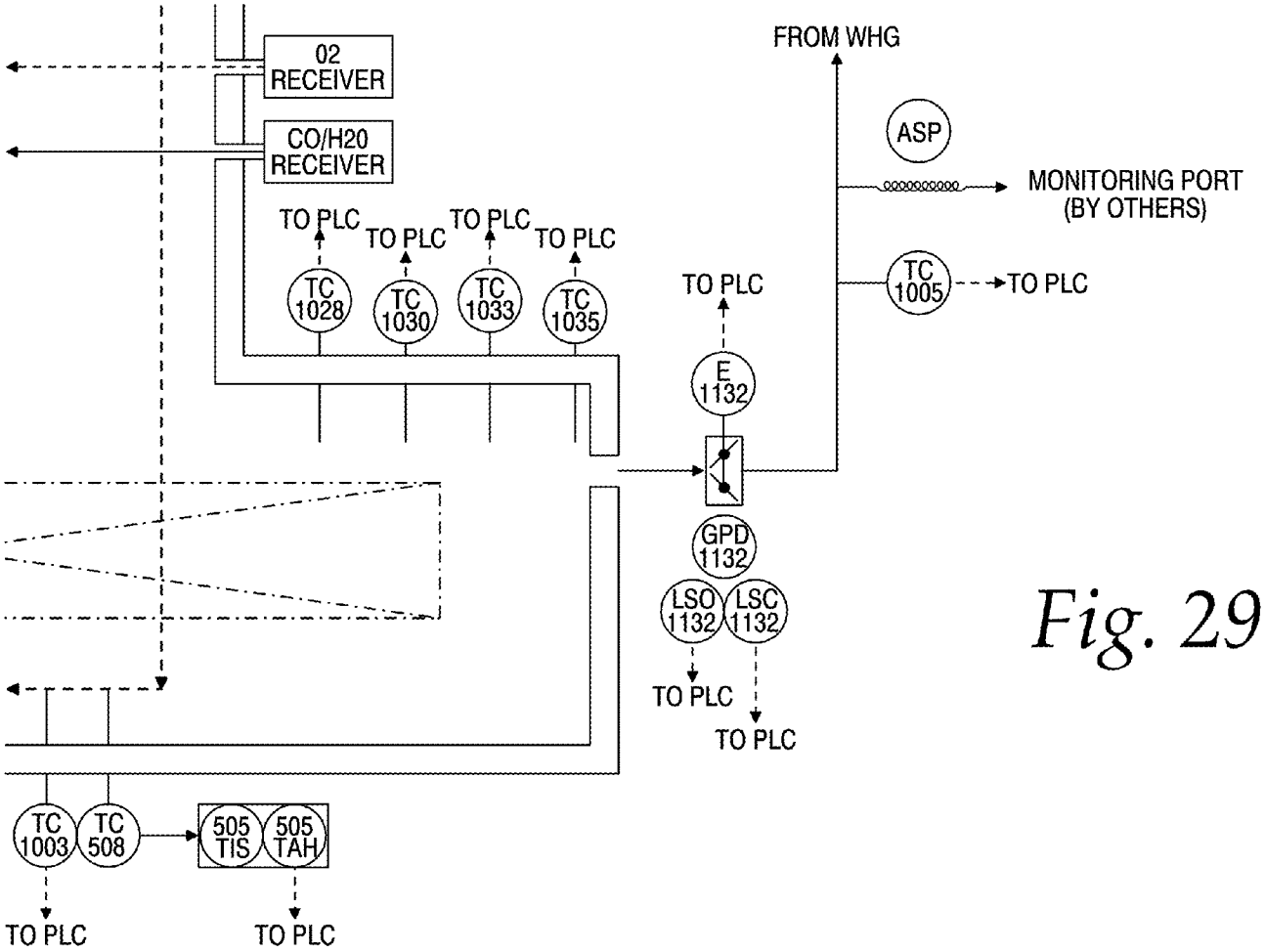
Figure 29E:
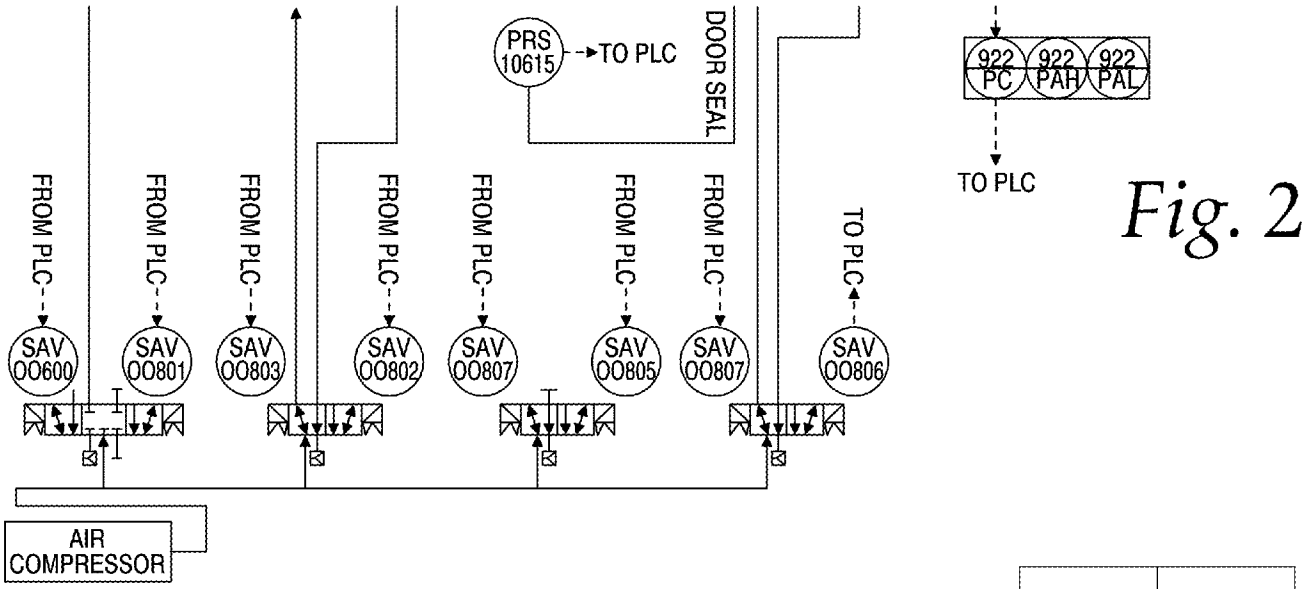

The waste heat generator 18 is actuated via a temperature-induced programmable logic controller (PLC). The PLC initially energizes a booster fan 72, which initially purges the system with ambient air. (FIG. 26 is a schematic depiction of the programmable controller output to the green "cycle running" lights and the solenoid gas purge valves.) Also, the heating element 70 is activated so as to gradually bring the system up to a predetermined operating temperature, so determined given the anticipated volatiles and constituents of product gas from the gasifier. The PLC monitors the temperature in the heat exchanger 74, the combustion chamber 66, and the burner chamber 71. This temperature monitoring feature assures that extreme temperature fluctuations do not occur.

Once the predetermined operating temperature is reached, the PLC enables the process lines to feed into the waste heat generator, or else holds the system idle until production is ready. Once production is ready, the fresh air purge dampener 68 closes and one or more of the diverting dampers open to draw volatile organic compounds from the gasifier via the gasifier's fluid means of egress 20.

The VOC-laden process air stream is then directed into the condensate evaporate section 73 where it is preheated to eliminate any vapor droplets before entering the floating tube primary heat exchanger 74. This step protects the leading edge of the heat exchanger from condensate build-up and subsequent pre-ignition. When the stream enters the floating tube heat exchanger, it is continuously preheated at close to the thermal conversion temperature before being sent through the low NOx burner.

The contaminated air stream next passes through an elongated high velocity combustion chamber 66. Here a series of strategically placed mixing baffles 67 creates turbulence and improves mixing, helping to prevent temperature stratification. From there the air stream rebounds 180° to assure proper mixing of all the effluent constituents. Even at low flow conditions, this mixing action provides the highest possible temperature uniformity for industry leading destruction ability at the lowest operational cost.

Once mixed, the air stream is held in the dwell chamber long enough to ensure complete combustion of the VOC's. From there the clean stream passes over the floating tube primary heat exchanger prior to being discharged to the atmosphere or to a secondary heat recovery system.

A plurality of thermocouples 58 are placed along the waste heat generator 18 to monitor temperatures of the gas passing through the waste heat generator.

A gas inlet port 60 situated at a proximal end of the waste heat generator is in fluid communication with the conduit 22 permitting passage of gas from the gas egress means 20. A distal end 62 of the waste heat generator terminates in a treated gas means of egress 64. Intermediate the proximal and distal ends, the waste heat generator defines a second reaction chamber 66 which is generally elongate in configuration. Flow into and flow out of gas ports are determined by gas inlet and outlet current loops, such as those schematically depicted in FIG. 23.

Inasmuch as a function of the waste heat generator 18 is to detoxify, by oxidation, gases produced in the gasification chamber, a make-up air fan 68 or some similar means for injecting oxygen into the waste heat generator is provided. The make-up air fan 68 is positioned in close spatial relation to the proximal end of the waste heat generator so as to subject incoming gas emanating from the gasifier's gas means of egress to oxygen. At this juncture, gas temperatures of between 750 and 950° F. are present.

Downstream of the proximal end of the gasifier and situated within the gasifier between its proximal and distal end is a plurality of heating means, such as heating elements 70. Treatment of the incoming gas with the heating means results in an elevation of gas temperatures to between 2000 and 2400° F. These temperatures facilitate achieving the energies of activation necessary to oxidize components of the producer gas to their nearly fully oxidized forms, as depicted in Equation 1 below:

$$H_2+CO+O_2H_2O+CO_2 \qquad \text{Equation 1}$$

A negative pressure fan 72, in fluid communication with an intermediate region of the waste heat generator 18, provides a means for drawing producer gas, emanating from the gasification chamber, through the waste heat generator. Ultimately, treated gas leaves the waste heat generator at the distal end of the waste heat generator to be vented to the atmosphere.

Example 1

The invented system is designed to reduce municipal solid waste in a myriad of volumes. The following table provides a one-third scale of a full scale system. The system is comprised of one electric heated batch furnace with a pneumatically operated vertical lift door at one end. The overall size of the furnace in this Example is 16 feet wide, 13 feet 9 inches long, and 25 feet 6 inches high (height includes vertical lift door in the up position). The furnace has an interior cavity measuring 11 feet 10 inches wide, 9 feet 11 inches long, and 9 feet 9 inches high. The furnace further features an exhaust duct from the gasifier chamber to a waste heat generator, which is approximately 25 feet in length. The system is controlled via a single control enclosure.

Fuel is transported to the interior furnace cavity via a rail system. The rail system consists of a track 80 leading to the furnace chamber and a number of rail cars. The rail cars are comprised of a 20.2 cubic yard container 14 for carrying the fuel and the bottom 28 of the container 14 is designed to engage the track 80. The container 14 has interior measurements of 11 feet wide, 8 feet 9 inches long, and 5 feet 8" high. The container 14 size ensures that 16.7 cubic yards of fuel is able to be introduced into the furnace in each batch.

The above described system is designed to process municipal solid waste (MSW) as fuel for the system. The system has a capacity to process 6,700 pounds of MSW based on an estimated MSW density of 400 pounds per cubic yard. Each batch of MSW this size is processed in approximately 8-12 hours. Each batch is delivered via the aforementioned rail cars.

The system begins gasification at a starting temperature of approximately 500° F.-600° F. During the course of operation, the gasification chamber will average a temperature of approximately 1400° F. The gasification chamber may achieve a maximum temperature of 1,700° F. during operation.

Gasification Chamber

Loading Detail

A fork lift is used to remove the container 14 from the base of the rail car. The containers 14 will provide 16.7 cubic yard total capacity when loaded with MSW. Once loaded, the container 14 is lifted with the fork lift and placed back onto the rail car base.

The entry end vertical door is opened. The fork lift will engage the rail car and push it in to the gasifier. The entry end vertical door is closed.

Upon completion of the process cycle, the entry door will open. The fork lift will engage the rail car and remove it from the gasifier and immediately replace it with the next load. The entry door will close.

The fork lift will remove the container 14 from the car base for cleanout. The bin is equipped with a swing door 82 (as depicted in FIG. 3B) to allow for clean out of the recyclables, residual ash, and debris.

Gasification Chamber

Heating Process Detail

Figure 21A:
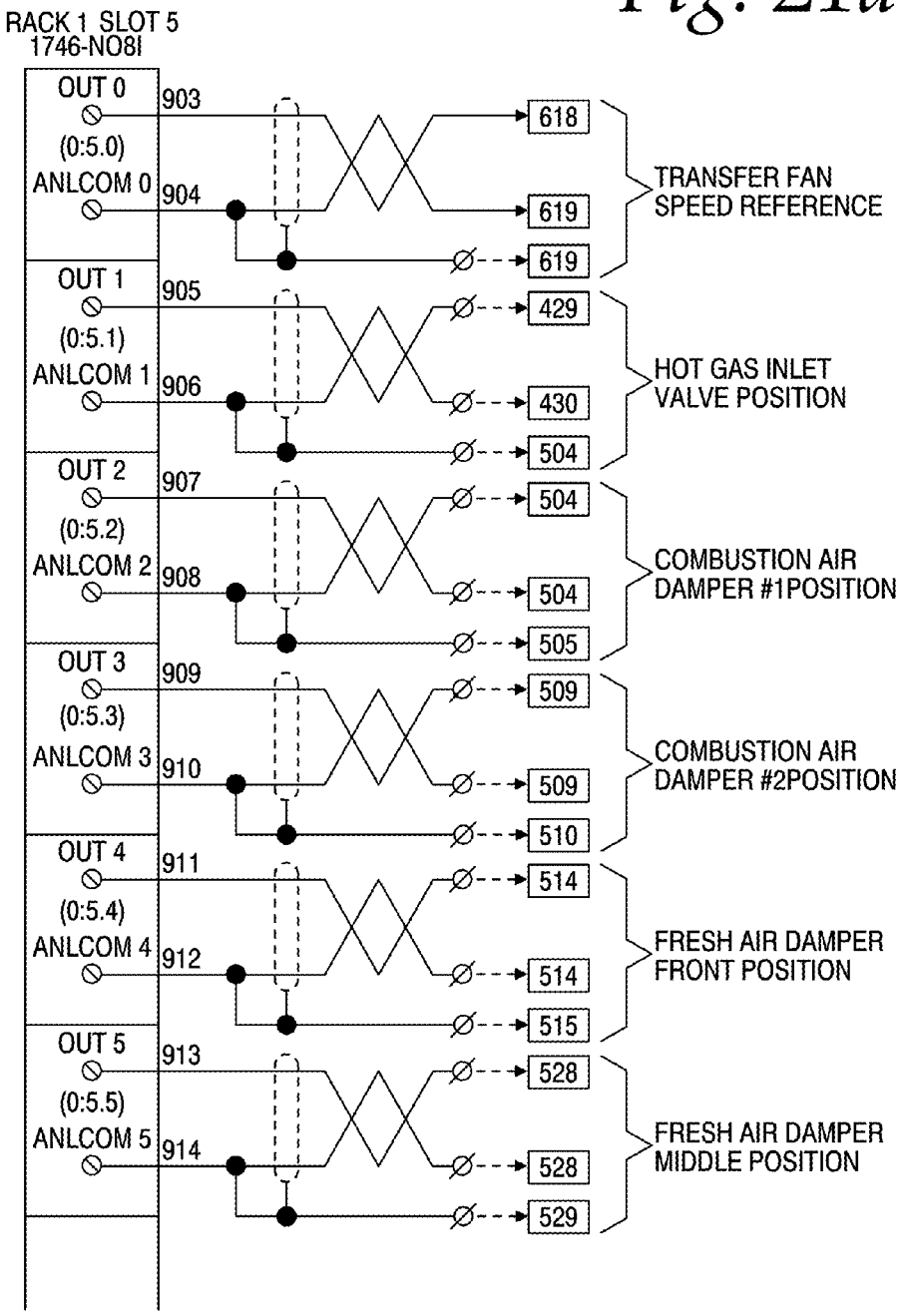
FIGS. 21*a-b* are a schematic depiction of the current output channels to the transfer fan and the gasification unit's dampers.
Figures 21A, 21B, 22B:
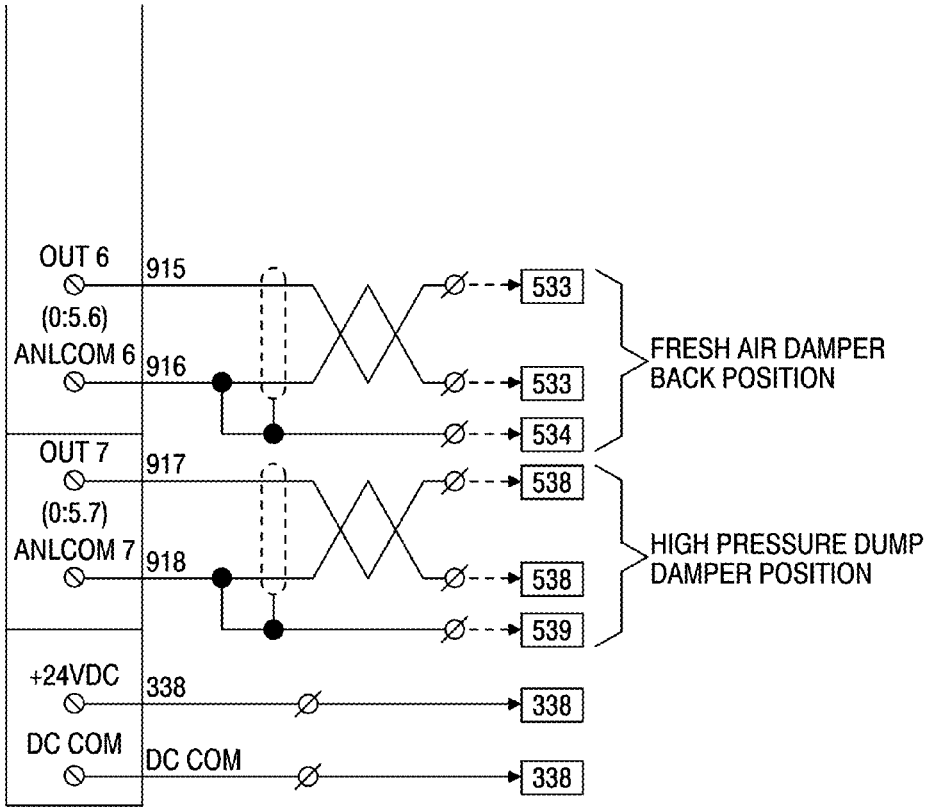
Figure 22:
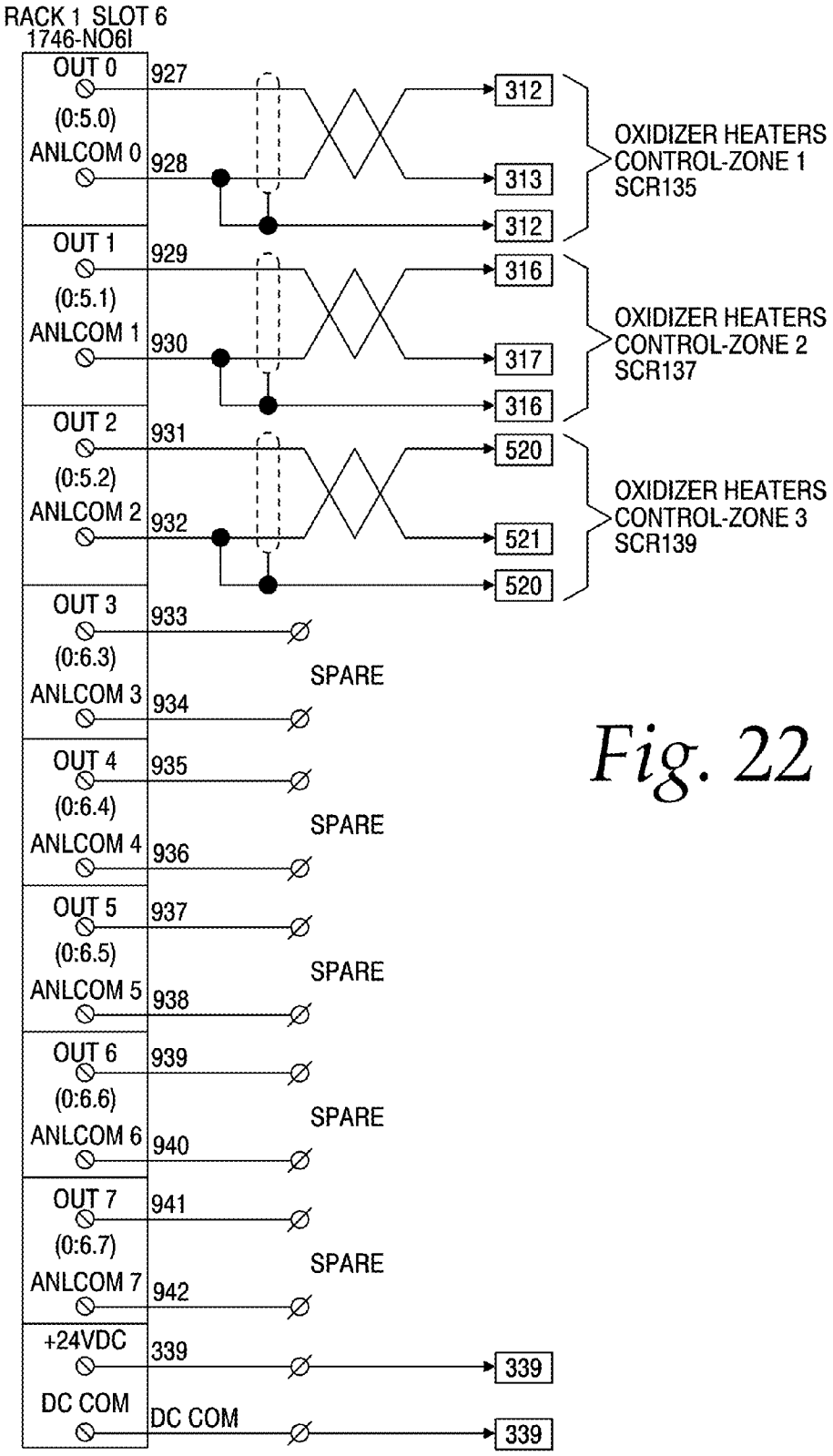
FIG. 22 is a schematic depiction of the current output channels to the oxidizer heater controllers.
Figure 23:
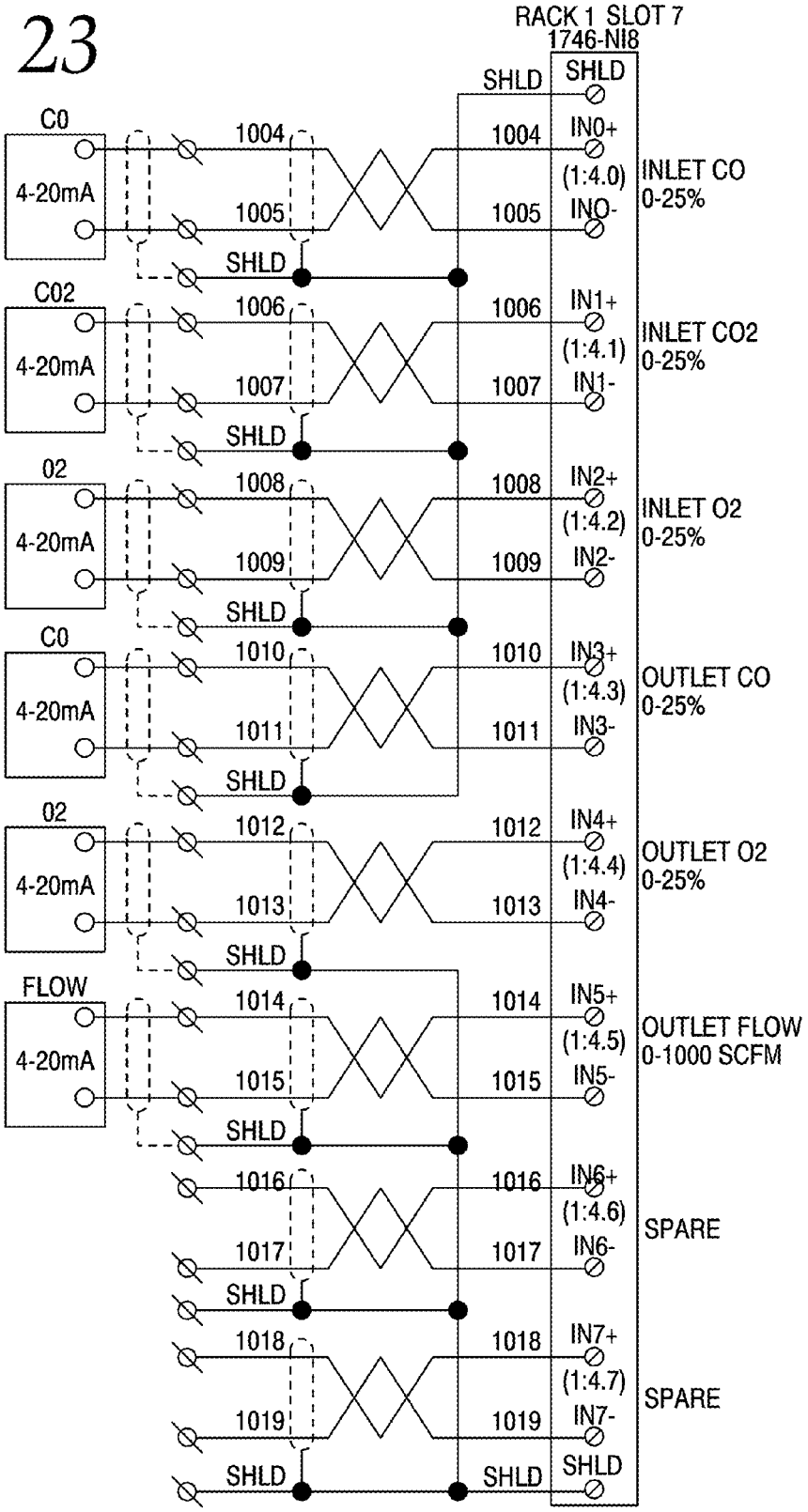
FIG. 23 is a schematic depiction of the gas inlet and outlet current loops.
Figure 24A:
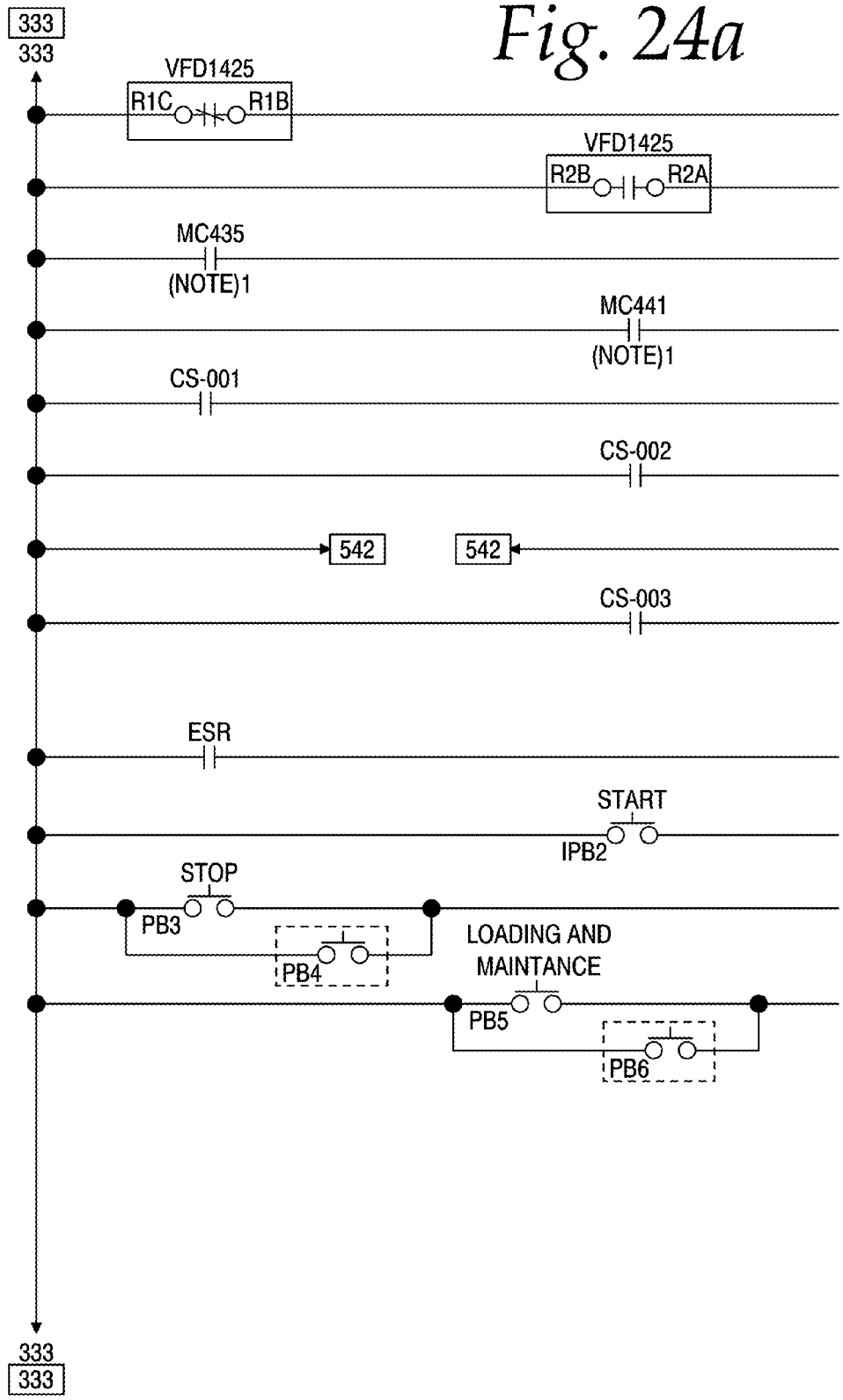
FIGS. 24*a-b* are a schematic depiction of the input module for the variable-frequency drives, contactors, and push button switches located on the DC power supply.
Figure 24B:
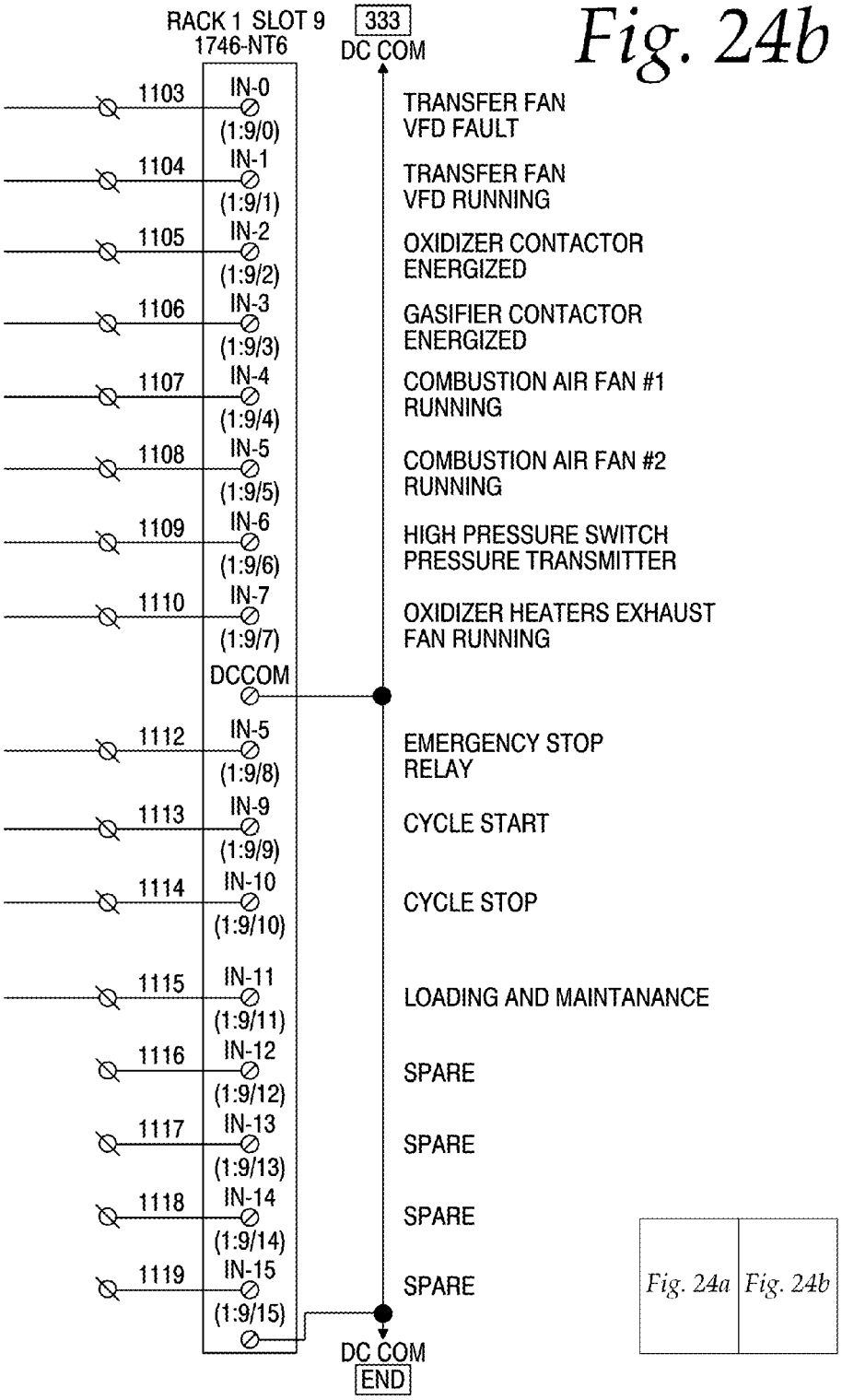
Figure 25:
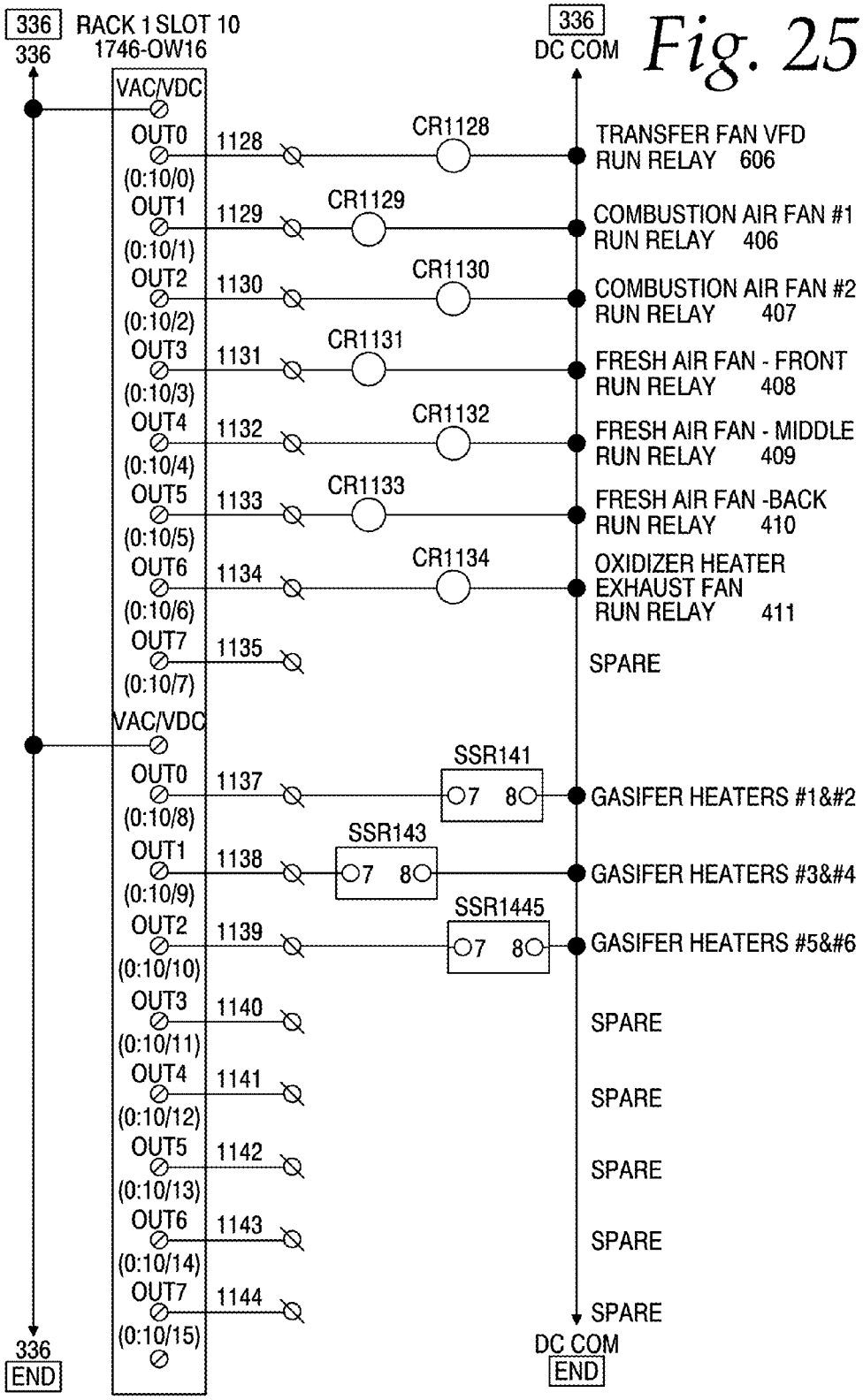
FIG. 25 is a schematic depiction of the output module leading to the relays that activate the fans and heaters.

Once a chamber is loaded and is in the Automatic mode, the process cycle executes as follows:

An output signal from the waste heat generator indicating the system is "On" is required before the Gasification "Start Process" will initiate. A schematic depiction of various output signal functions is depicted in FIGS. 21*a-b* and 22. With the waste heat generator "On", the recirculation fan and furnace heaters turn on. The hot gas exhaust and fresh air intake dampers are in the closed position as the furnace begins the cycle. As the feedstock (MSW) begins to dry and reach the process start temperature, materials with auto ignition temperatures of approximately 400° F.-450° F. will begin to thermal decompose or otherwise convert, in turn, releasing heat to the load and consuming oxygen within the chamber.

The CO, $CO_2$, and $O_2$ in the hot gas exhaust is monitored during this phase of the process. As the oxygen level in the hot gas stream begins to decrease, the fresh air intake and hot gas exhaust dampers begin to modulate open. A schematic diagram of a representative damper is found in FIG. 15A.

The incoming fresh air mixes with the recirculation chamber air and passes through the feedstock (MSW). This promotes the gasification process. As the gasification process accelerates, the chamber hot gas temperature begins to increase, triggering the temperature controller's second set point. Schematic detail of the temperature controllers are found in FIGS. 11*a-b*. At this predetermined temperature the gasification process is sustained and the furnace heaters will ramp down eventually turning off. The hot gas exhaust temperature and CO, $CO_2$, and $O_2$ levels will continue to be monitored and controlled by the modulating dampers. A myriad of suitable modulating dampers can be adapted to provide this feature, including Unique Sensing Device™, available from Yokagawa Company, Houston, Tex.

The gasification chamber can also be controlled by the operator manually. Based on the temperature feedback from the thermocouples 58, the operator can determine if the waste is undergoing gasification. For instance, the level of moisture in the waste may vary from load to load. Therefore, the operator will be able to tell by the temperature in the chamber whether the waste is still dehydrating. When the temperature resumes its ascent, then the operator will know that gasification is beginning. Further, the operator can tell from the temperature gradient within the chamber whether gasification is occurring. When the syngas is stagnant in the chamber, the temperatures at both ends of the chamber will be close to equal. When the syngas is properly flowing, one end of the chamber will consistently measure in the range of 1200-1300° F., while the other end will consistently measure in the range of 1700-1800° F. Finally, the operator can tell if gasification is occurring depending on the color of the exhaust. When the waste is simply combusting, the exhaust smoke will be black or gray. However, when the waste is gasifying properly, the exhaust will be colorless heat waves. Based on these above described feedbacks, the operator can manually adjust the intake dampers to achieve the proper level of oxygen in the chamber.

As the feedstock decreases, the oxygen level will begin to increase. The fresh air intake and hot gas exhaust dampers will continue to modulate until the feedstock is thermally composed, such as by gasification. Once the oxygen level increases for a preset time, the dampers will modulate full open, starting the cool down cycle.

The cool down cycle will continue to run until the chamber air temperature reaches a preset temperature. The operator is alerted that the cycle is complete.

After the cycle is complete, the furnace doors open and the rail car is pulled from furnace.

Batch Furnace

Construction Detail

The furnace is constructed of 7-gauge carbon steel outer shell stiffened with structural members. The walls, roof, and floor include a combination of high temperature ceramic fiber blanket and mineral wool board for a total of 6" of 10 and 8-pound density insulation. The insulation is secured in place by stainless steel pins welded to the outer shell. The insulation is rigidized with a spray-on coating of ceramic fiber. The furnace further comprises a 7-gauge carbon steel floor. An 8" structural steel base frame is provided to support the furnace.

A heat shield is provided on the sidewalls and ends on the furnace, providing a thermal barrier between the furnace outer shell and heat shield. The heat shield is constructed of corrugated metal fastened to the outer shell structural stiffeners.

One (1) pair of alloy car rails rated for 1,700° F. is positioned inside the furnace. The rails are secured to the furnace floor and adapted to match rails external of the unit.

Furnace

Door Detail

In this example, one air-operated vertical lift door assembly is provided at one end of the furnace. The door is constructed of carbon steel plate and structural members and insulated with ceramic fiber insulation similar to the furnace body. The door guides are arranged with clamping assemblies, which hold the door against the door opening when closed, providing a suitable thermal and atmospheric seal. Limit switches serve to indicate the door position. Optionally, a safety shot-pin assembly is provided to secure the door once in the raised position.

Recirculating Air System Detail

The furnace features a recirculation air system designed to circulate heated air past the (MSW), improving temperature uniformity, and heat-up and process rates. The recirculation air system can also be used during the cool down cycle which in turn can decrease overall process times.

The furnace ductwork is constructed of 18-gauge type-304 stainless steel suitably reinforced. Side mounted ducts are provided along the length of the furnace.

The heated air will discharge from the ducts and pass through openings in the sidewall of the rail car before returning vertically to the recirculation blower located on the top of the chamber.

Figure 19:
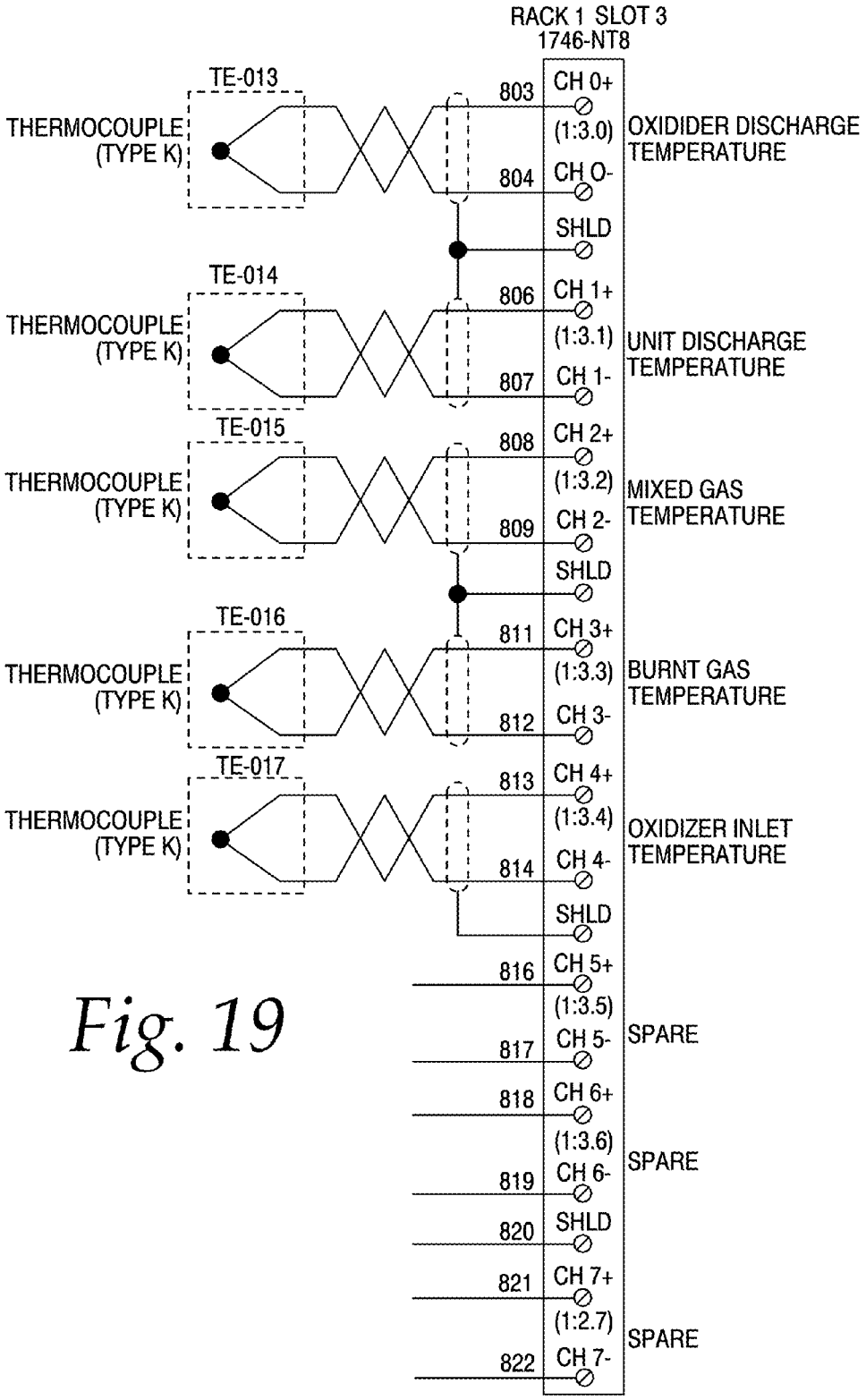
FIG. 19 is a schematic depiction of the thermocouple locations of the oxidizer discharge, unit discharge, mixed gas, burnt gas, and oxidizer inlet.
Figure 20:
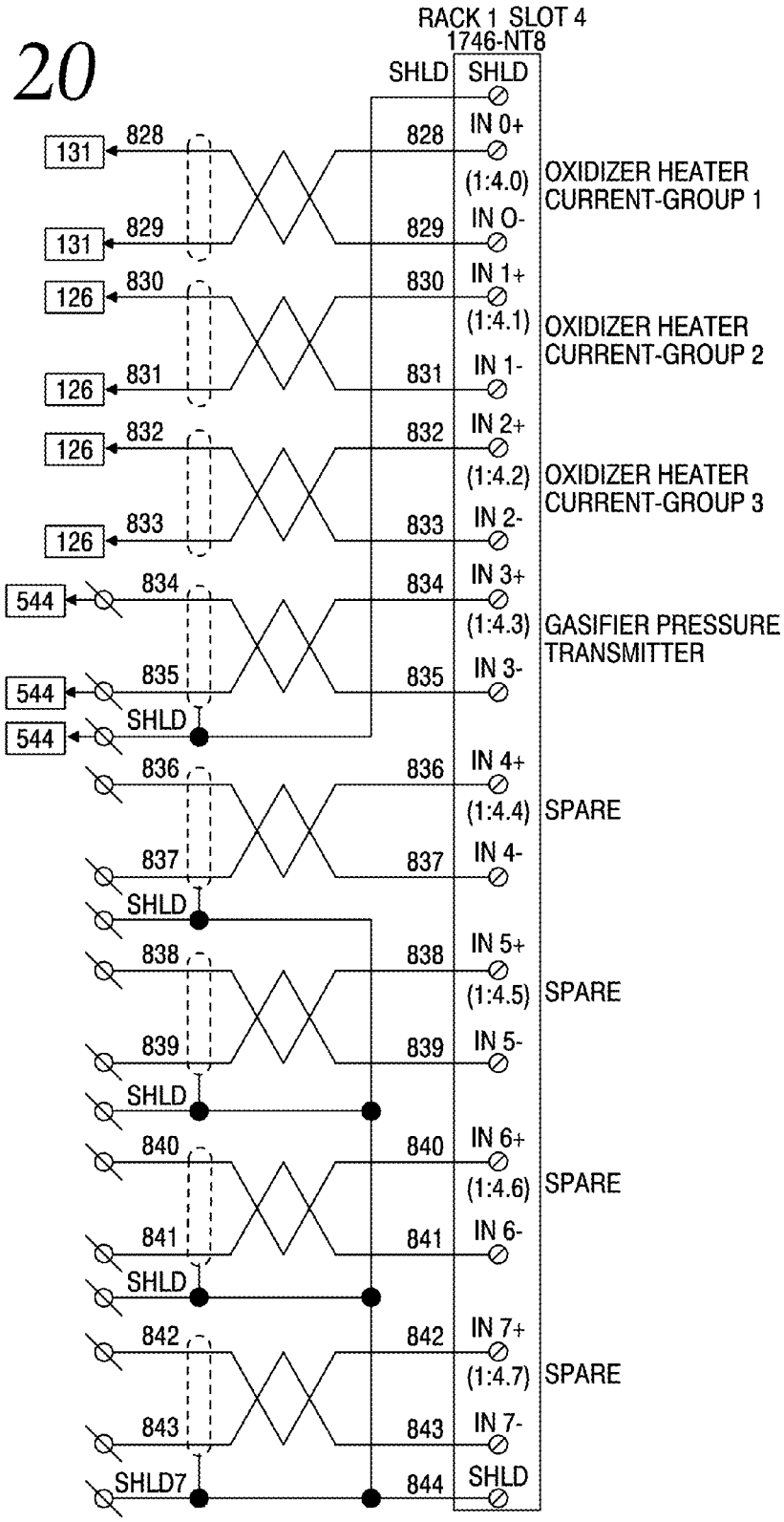
FIG. 20 depicts a schematic representation of the input current that travels from the current transducers of FIG. 10 and the pressure transmitter of FIG. 15B.

At least one 10,200 CFM (cubic feet per minute) recirculation fan is provided complete with a 20 HP premium efficient TEFC (totally enclosed, fan cooled) motor, fixed V-belt drive, durable OSHA belt guard, and an Allen-Bradley Powerflex variable frequency drive. All fan components in contact with the air stream are stainless steel, rated for 1,700° F. maximum. The fan includes ceramic felt shaft seals that will provide better than 99% seal. FIG. 19 depicts input modules for the various frequency drives used in the invented system.

Heating

System Detail

The furnace is heated by two (2) 48 kW heater plugs providing a total connected load of 96 kW. Each heater plug will include incoloy sheathed heating elements supported by stainless steel brackets. The heater plugs are powered through an SCR control designed to operate continuously from 0 to 100% output.

Exhaust

System Detail

A transfer fan is integrated with the waste heat generator 18. The transfer fan vacates the furnace chamber during the process cycle. A schematic depiction of a transfer fan and its control circuitry is FIGS. 16*a-b*.

A fresh air intake 68 and hot gas exhaust damper is provided. The intake damper will have a 99% shutoff rating when closed, and the hot gas damper will have a 95% shutoff rating when closed. Each damper include a modulating mechanism capable of receiving an analog signal from the Purchaser's PLC.

A powered fresh air supply fan 72 is positioned upstream of the intake damper. The fan is rated for 360 standard CFM (maximum) and will include a 1 HP premium efficient TEFC motor, and an Allen-Bradley Powerflex variable frequency drive.

Stackwork is provided from the gasifier hot gas damper to the waste heat generator. The stackwork will include 25' of straight stack, (2) 90-degree elbows, connecting flanges and gaskets. Stack Insulation and sheet steel cover will also be included. The exhaust damper size is based on a total SYN gas flow rate of 580 actual CFM (150 standard CFM) at 1,600° F. gas temperature. These numbers will need to be confirmed in order to finalize the damper sizes, as well as the waste heat generator and transfer fan requirements.

⅓ Scale

Container Detail

The (16.7) cubic yard capacity rail car defines one (1) holding bin; and a lower air plenum section. The bin is designed for removal with a fork lift. The bin also includes a swing door for ease of cleanout. The lower section of the car includes a hopper for ash collection. The hopper is equipped with a manual slide gate for cleanout.

A hearth fabricated of carbon steel bar grating and structural steel members is provided to support the load. The load hearth is made as part of the bin.

The bin and lower air plenum section is supported by structural steel members and four (4) flanged wheels rated at 5-tons each. The wheels and bearings are a cast alloy rated for 1,700° F. operation. The axles are made of a 330 stainless steel.

Control

Enclosure Detail

All instruments and controls required for the operation of the gasifier is provided in one (1) NEMA 12 style control enclosure. The panel will include International Electrotechnical Commission (IEC) rated motor starters, selector switches, pushbuttons, pilot lights, fuses, fuse blocks, step-down control transformer, relays, alarm horn, and flange mounted safety disconnect switch. All components are Allen-Bradley IEC where applicable. A 3-color stack light is provided to indicate the status of the process.

An Allen Bradley Micro Logix 1500 PLC and Panelview 600 operator interface controls the system operation. The PLC includes the following:

1. Discrete I/O to control the system logic, i.e. vertical lift door with clamp seals, recirculation fan, heaters, and waste heat generator on/off input signal. However, control of the dampers and the oxygen levels will be accomplished with the Purchaser's hardware and proprietary software.

2. One (1) Honeywell UDC 2500 digital controller controls the process air stream temperature inside the furnace. The controller comprises a proportional control output and a type "K" thermocouple input. The controller includes a second set point alarm output that will turn off the heaters once the process reaches a preset temperature.

3. One (1) Honeywell UDC 2500 digital excess temperature controller is configured for a type "K" thermocouple. The controller features a manual reset switch wired to shut off the heat and sound an alarm in the event of an over temperature condition.

Figure 17:
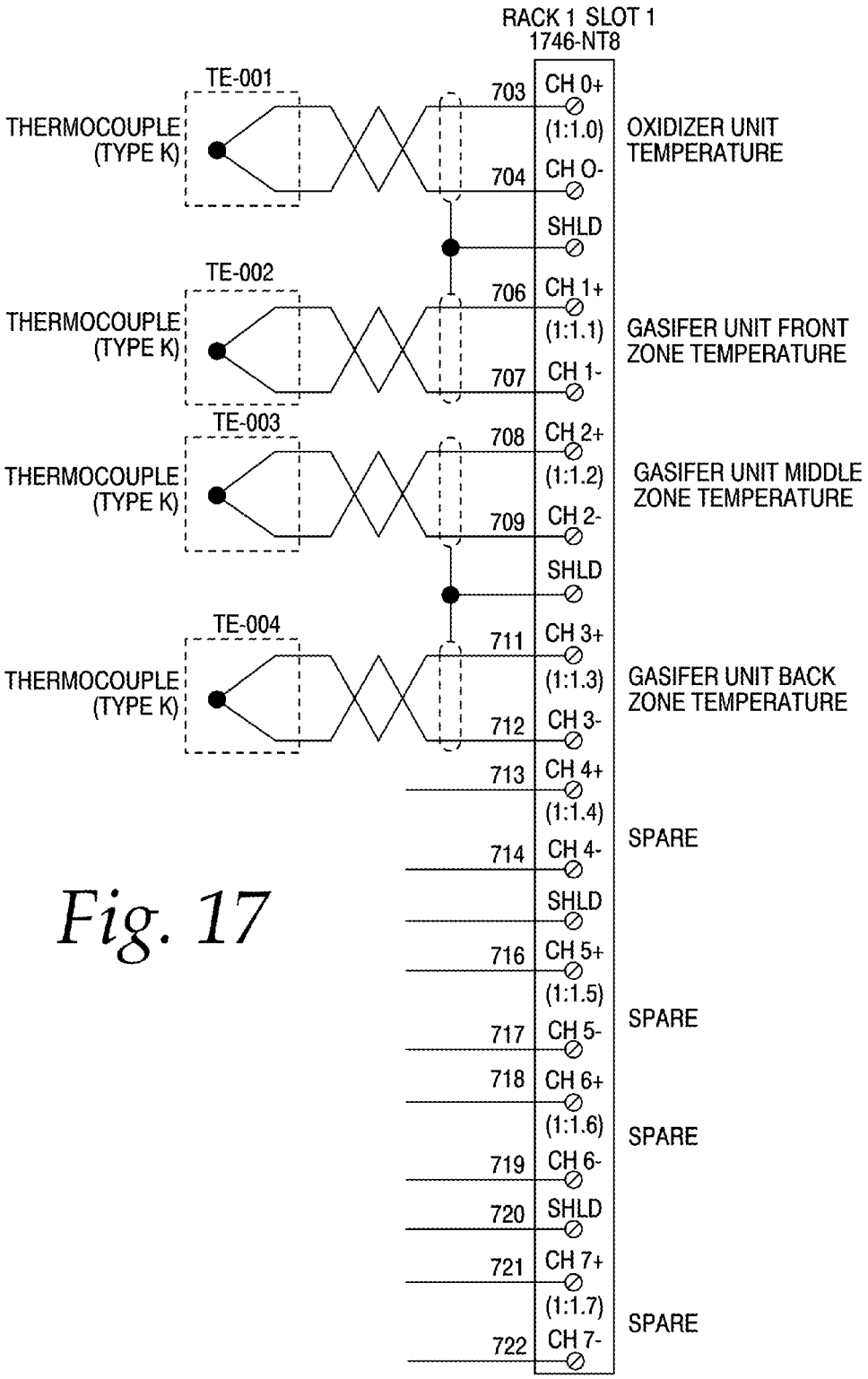
FIGS. 17 and 18 are a schematic depiction of the thermocouple placements in the gasifier unit.
Figure 18:
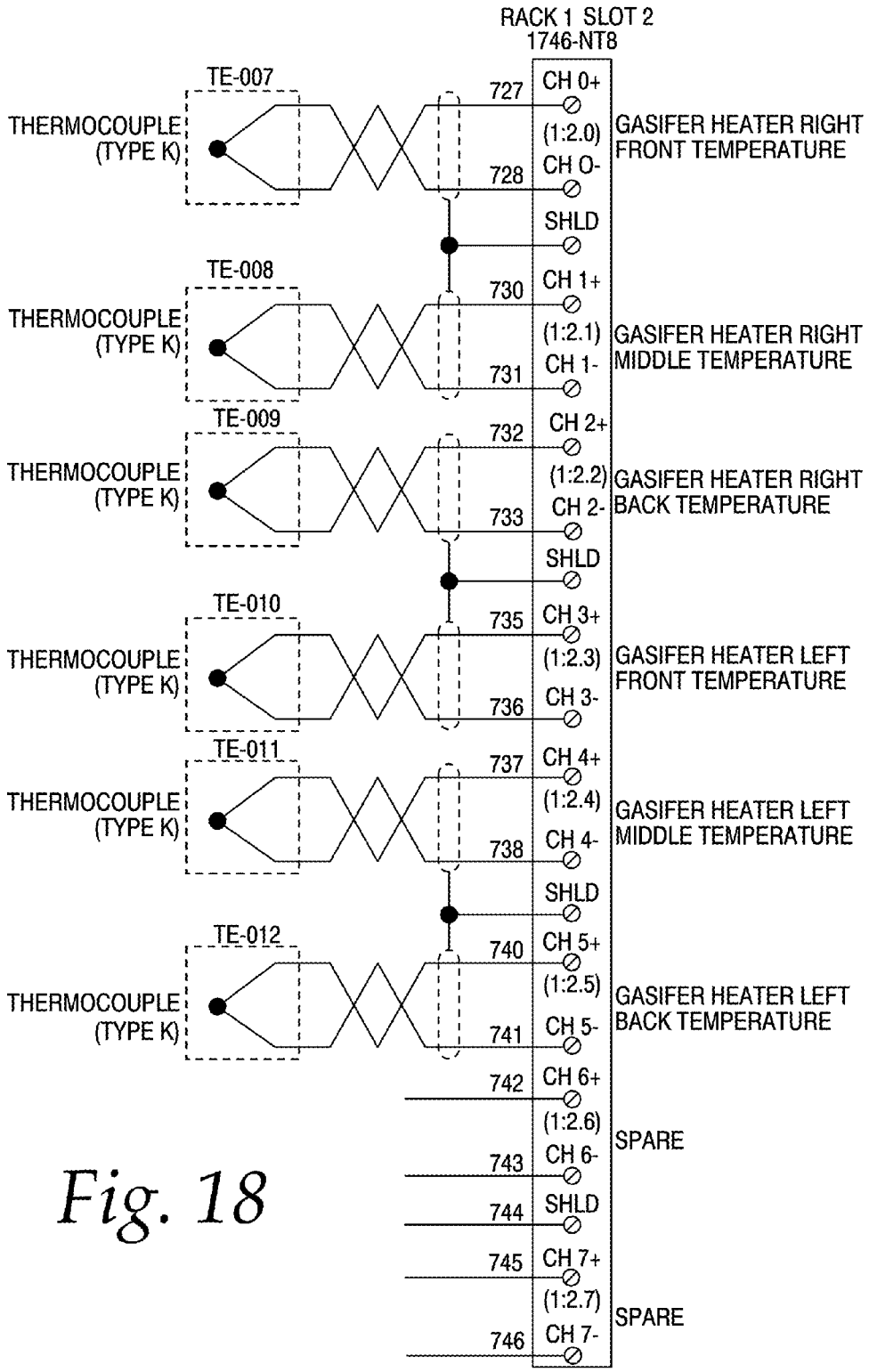

4. Two (2) thermocouple panels are provided for monitoring process temperatures. Each panel is equipped with five (5) type "K" thermocouple terminals. Thermocouple wire from the panels to the final measuring locations will be the responsibility of the Purchaser. Data acquisition is accomplished with the aforementioned hardware and proprietary software. FIGS. 17-19 depict placement and detail of the plurality of thermocouples distributed throughout the modular gasification unit.

Extrinsic power requirements of the fully scalable ⅓ mock up includes electrical service at 460 Volts, 3 Phase, 60 Hertz, with a maximum of about 150 amps required. Approximately a minimum of 80 psig of compressed air is required.

Although an exemplary implementations of the invention has been depicted and described in detail herein relating to Example 1, it will be apparent to those skilled in the relevant art that various modifications, additions, substitutions, and the like can be made without departing from the spirit of the invention and these are therefore considered to be within the scope of the invention as defined in the following claims.

For example, it should be noted that FIG. 1 depicts a negative pressure fan 21 positioned exterior of the gasification chamber. However, FIG. 7, depicting an alternative embodiment of the gasifier, illustrates a negative pressure fan 21 within the confines of the gasifying chamber.

The invention claimed is:

1. A system for reducing the volume of bulk material, the system comprising:

a. a transportable container;

b. a single gasification chamber adapted to removably receive said transportable container wherein the single chamber has an interior and exterior surface;

c. a plurality of electrically-charged heating elements capable of heating said chamber to at least 1200° F.;

d. a waste heat generator in fluid communication with the chamber; and e. at least one medially-directed fan positioned on the interior surface of the single chamber wherein said at least one fan homogenizes the atmosphere within the single chamber.

2. The system as recited in claim 1, wherein the transportable container is adapted to receive municipal waste.

3. The system as recited in claim 1, wherein the transportable container comprises solid walls, an open top and a horizontally disposed perforated floor.

4. The system as recited in claim 3 wherein the transportable container comprises first perforated floor which contacts the waste and a second floor inferior to the first floor and spaced from the first floor to define a space between the first floor and the second floor.

5. The system as recited in claim 4 wherein said transportable container further comprises a plurality of vertically disposed conduits which extend upwardly from the first floor to the height of the container.

6. The system as recited in claim 1 wherein said chamber comprises a means for simultaneously establishing different atmospheres within said chamber.

7. The system as recited in claim 1, wherein the chamber further defines heated fluid conduits to direct heated fluid from one region of the chamber to regions of the container forming apertures.

8. The system as recited in claim 1 wherein the waste heat generator comprises a means for subjecting fluid to at least 1600° F.

9. A method for simultaneously thermally degrading different waste differently in a single chamber, the method comprising:

a. establishing a controlled atmosphere within the chamber and applying heat to the waste for a time and at a temperature sufficient to gasify the waste, wherein applying heat to the waste further comprises heating the chamber until the temperature within said chamber reaches at least 1200° F.;

b. collecting data during gasification regarding the thermal degradation of the waste; and c. applying the collected data to an algorithm to adjust the temperature and oxygen concentrations for each preselected position.

10. The method as recited in claim 9 wherein the thermal degradation data includes temperature readings, gas emissions, and weight changes of the waste at each preselected position.

11. The system as recited in claim 1 wherein the waste heat generator is supported by an exterior surface of the chamber.

12. The system as recited in claim 1 wherein the waste heat generator is positioned downstream of the chamber.

* * * * *